US011753901B2

(12) United States Patent
Schultz et al.

(10) Patent No.: US 11,753,901 B2
(45) Date of Patent: Sep. 12, 2023

(54) FLUID PULSE GENERATION IN SUBTERRANEAN WELLS

(71) Applicant: THRU TUBING SOLUTIONS, INC., Newcastle, OK (US)

(72) Inventors: Roger L. Schultz, Newcastle, OK (US); Andrew M. Ferguson, Moore, OK (US); Timothy Manke, Oklahoma City, OK (US); Brett A. Fears, Mustang, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 154 days.

(21) Appl. No.: 17/193,249

(22) Filed: Mar. 5, 2021

(65) Prior Publication Data

US 2021/0277743 A1 Sep. 9, 2021

Related U.S. Application Data

(60) Provisional application No. 63/036,787, filed on Jun. 9, 2020, provisional application No. 62/985,399, filed on Mar. 5, 2020.

(51) Int. Cl.
*E21B 34/06* (2006.01)
*E21B 43/12* (2006.01)

(52) U.S. Cl.
CPC ..... *E21B 34/06* (2013.01); *E21B 43/121* (2013.01)

(58) Field of Classification Search
CPC ..... E21B 34/06; E21B 43/12; E21B 43/121
See application file for complete search history.

(56) References Cited

U.S. PATENT DOCUMENTS 4,058,163 A 11/1977 Yandell
4,890,682 A 1/1990 Worrall et al.
(Continued)

FOREIGN PATENT DOCUMENTS

CA 2680895 A1 3/2011
CN 110374508 A 10/2019
(Continued)

OTHER PUBLICATIONS

NOV Wellbore Technologies; "Agitator Systems", company brochure No. 10107680-201-ENG-MKT-CDT41, dated 2015, 5 pages.
(Continued)

*Primary Examiner* — Matthew R Buck
(74) *Attorney, Agent, or Firm* — Smith IP Services, P.C.

(57) ABSTRACT

A fluid pulse generator can include a fluid motor including a rotor that rotates in response to fluid flow, a variable flow restrictor positioned upstream of the fluid motor and including a restrictor member rotatable relative to a ported member and longitudinally displaceable relative to the rotor. Another fluid pulse generator can include a flex joint or a constant velocity joint connected between the restrictor member and the rotor. In another fluid pulse generator, the variable flow restrictor can include a valve and a fluidic restrictor element, the valve being operable in response to rotation of the rotor, the fluidic restrictor element being configured to generate fluid pulses in response to the fluid flow through a flow path, and the valve being configured to control the fluid flow through another flow path connected in parallel with the first flow path.

31 Claims, 33 Drawing Sheets

(56) References Cited

U.S. PATENT DOCUMENTS

| | | | | |
|---|---|---|---|---|
| 6,237,701 | B1 | 5/2001 | Kolle et al. | |
| 6,279,670 | B1 | 8/2001 | Eddison et al. | |
| 6,431,294 | B1 | 8/2002 | Eddison et al. | |
| 6,439,318 | B1 | 8/2002 | Eddison et al. | |
| 6,508,317 | B2 | 1/2003 | Eddison et al. | |
| 7,139,219 | B2 | 11/2006 | Kolle et al. | |
| 7,389,830 | B2 | 6/2008 | Turner et al. | |
| 7,575,051 | B2 | 8/2009 | Stoesz et al. | |
| 8,069,926 | B2 | 12/2011 | Eddison et al. | |
| 8,167,051 | B2 | 5/2012 | Eddison et al. | |
| 8,181,719 | B2 | 5/2012 | Bunney et al. | |
| 8,201,641 | B2 | 6/2012 | Allahar | |
| 8,381,817 | B2 | 2/2013 | Schultz et al. | |
| 8,439,117 | B2 | 5/2013 | Schultz et al. | |
| 8,448,700 | B2 | 5/2013 | Connell et al. | |
| 8,453,745 | B2 | 6/2013 | Schultz et al. | |
| 8,517,105 | B2 | 8/2013 | Schultz et al. | |
| 8,517,106 | B2 | 8/2013 | Schultz et al. | |
| 8,517,107 | B2 | 8/2013 | Schultz et al. | |
| 8,517,108 | B2 | 8/2013 | Schultz et al. | |
| 8,939,217 | B2 | 1/2015 | Kolle | |
| 9,194,208 | B2 * | 11/2015 | Schultz | E21B 34/06 |
| 9,212,522 | B2 | 12/2015 | Schultz et al. | |
| 9,249,642 | B2 | 2/2016 | Kolle | |
| 9,273,529 | B2 | 3/2016 | Eddison et al. | |
| 9,279,300 | B2 | 3/2016 | Kolle et al. | |
| 9,316,065 | B1 | 4/2016 | Schultz et al. | |
| 9,382,760 | B2 | 7/2016 | Le et al. | |
| 9,593,537 | B2 | 3/2017 | Gust | |
| 9,637,976 | B2 | 5/2017 | Lorenson et al. | |
| 9,637,991 | B2 | 5/2017 | Eddison et al. | |
| 9,915,107 | B1 | 3/2018 | Schultz et al. | |
| 10,358,872 | B2 | 7/2019 | Rossing et al. | |
| 10,415,324 | B1 | 9/2019 | Schultz et al. | |
| 10,465,475 | B2 | 11/2019 | Theimer et al. | |
| 10,513,900 | B1 | 12/2019 | Schultz et al. | |
| 10,590,709 | B2 | 3/2020 | Sicilian et al. | |
| 10,677,006 | B2 | 6/2020 | Von Gynz-Rekowski et al. | |
| 10,718,168 | B2 | 7/2020 | Donald et al. | |
| 10,724,318 | B2 | 7/2020 | Schultz et al. | |
| 10,724,323 | B2 | 7/2020 | Roseman et al. | |
| 10,829,993 | B1 * | 11/2020 | von Gynz-Rekowski | E21B 21/10 |
| 10,865,612 | B2 * | 12/2020 | Elfar | E21B 21/103 |
| 2003/0183388 | A1 * | 10/2003 | Toulouse | E21B 7/061 166/117.6 |
| 2006/0243493 | A1 | 11/2006 | El-Rayes et al. | |
| 2007/0187112 | A1 | 8/2007 | Eddison et al. | |
| 2009/0223676 | A1 | 9/2009 | Eddison et al. | |
| 2010/0276204 | A1 | 11/2010 | Connell et al. | |
| 2011/0073374 | A1 * | 3/2011 | Bunney | E21B 7/24 175/107 |
| 2013/0092246 | A1 | 4/2013 | Kolle | |
| 2015/0068811 | A1 | 3/2015 | Marchand et al. | |
| 2015/0075867 | A1 | 3/2015 | Eddison et al. | |
| 2015/0101824 | A1 | 4/2015 | Kolle et al. | |
| 2016/0108691 | A1 | 4/2016 | Kolle | |
| 2018/0171719 | A1 | 6/2018 | Donald et al. | |
| 2019/0040697 | A1 | 2/2019 | Barker | |
| 2019/0153797 | A1 * | 5/2019 | von Gynz-Rekowski | E21B 7/24 |
| 2019/0257167 | A1 | 8/2019 | Kinsella et al. | |
| 2019/0277092 | A1 | 9/2019 | Lebaron et al. | |
| 2020/0024924 | A1 | 1/2020 | Clausen et al. | |
| 2021/0301596 | A1 | 9/2021 | Schultz | |

FOREIGN PATENT DOCUMENTS

| | | | |
|---|---|---|---|
| CN | 110374509 | A | 10/2019 |
| WO | 2015191889 | A1 | 12/2015 |
| WO | 2018006178 | A1 | 1/2018 |
| WO | 2018231244 | A1 | 12/2018 |

OTHER PUBLICATIONS

NOV Wellbore Technologies; "AgitatorHE On-Demand Survey", Drilling Agitator Product Line brochure No. JIRA9527, dated 2020, 1 page.

NOV Wellbore Technologies; "AgitatorHE On-Demand System",Technical Specification brochure No. JIRA11998, dated 2020, 1 page.

NOV Wellbore Technologies; "Agitator Plus System", Technical Summary brochure No. 10132327-400-ENG-MKT:41/01, dated prior to Jan. 2021, 1 page.

Tempress; "Extended-Reach Tool" HydroPull Factsheet via www.tempresstech.com, dated prior to Jan. 2021, 5 pages.

National Oilwell Varco; "Agitator Tool", Technical Summary brochure No. D392001564-MKT-001 Rev.04, dated 2009, 2 pages.

Tempress; "Tempress HydroPull Tool", company brochure, dated prior to Jan. 2021, 5 pages.

International Search Report with Written Opinion dated Jun. 30, 2021 for PCT Patent Application No. PCT/US/2021/02165, 13 pages.

International Search Report with Written Opinion dated Jul. 6, 2021 for PCT Patent Application No. PCT/US/2021/024736, 11 pages.

Office Action dated Jun. 21, 2022 for U.S. Appl. No. 17/216,539, 26 pages.

* cited by examiner

FLUID PULSE GENERATION IN SUBTERRANEAN WELLS

BACKGROUND

This disclosure relates generally to equipment utilized and operations performed in conjunction with a subterranean well and, in an example described below, more particularly provides for fluid pulse generation in wells.

It can be advantageous in some situations to be able to periodically or intermittently restrict or block fluid flow through a tubular string in a well. Such fluid flow restrictions can result in corresponding fluid pulses being produced in the tubular string. In some examples, the fluid pulses can aid in advancing the tubular string through the well, such as, by causing vibration of the tubular string, producing a water hammer effect, and/or reducing friction between the tubular string and a wall of a wellbore.

Therefore, it will be appreciated that improvements are continually needed in the art of generating fluid pulses in subterranean wells. Such improvements may be useful in a variety of different well operations (for example, drilling, completion, stimulation, injection, production, etc.) and for a variety of different purposes.

DETAILED DESCRIPTION

Figure 1:
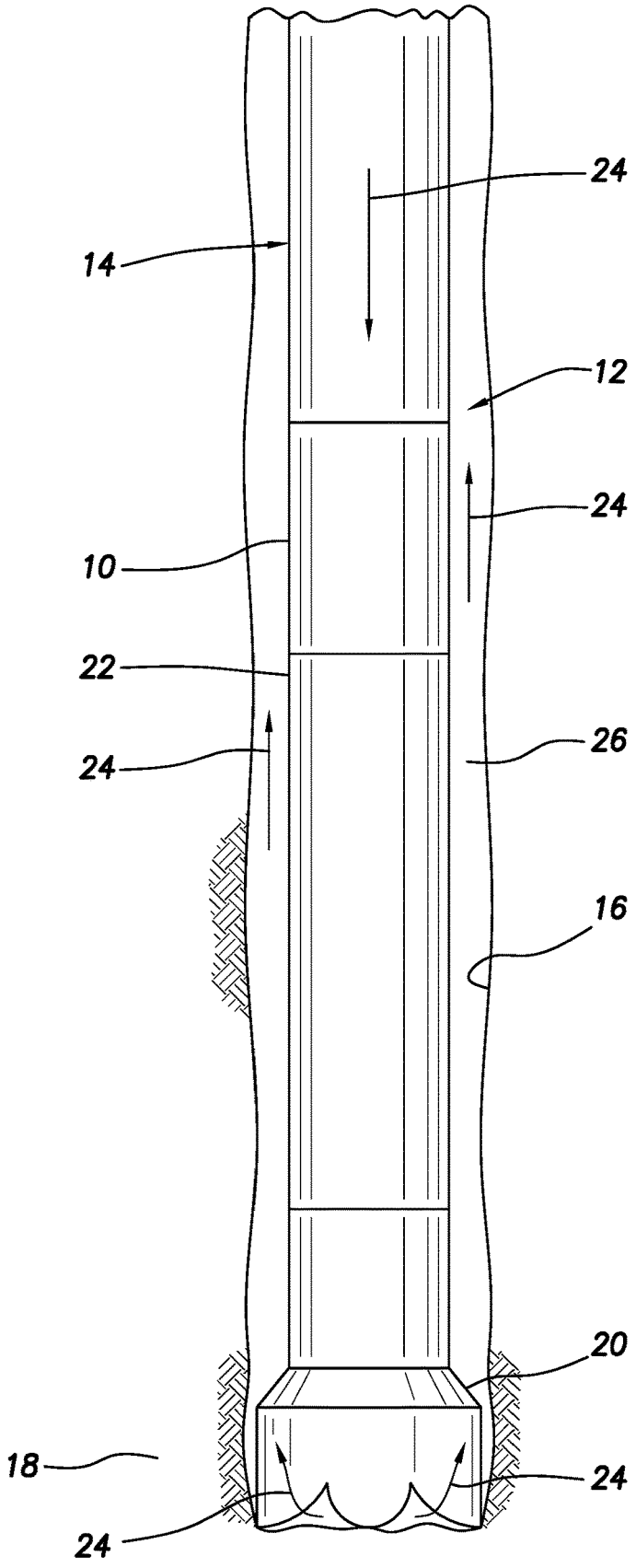
FIG. 1 is a representative partially cross-sectional view of an example of a well system and associated method which can embody principles of this disclosure.
Figure 63:
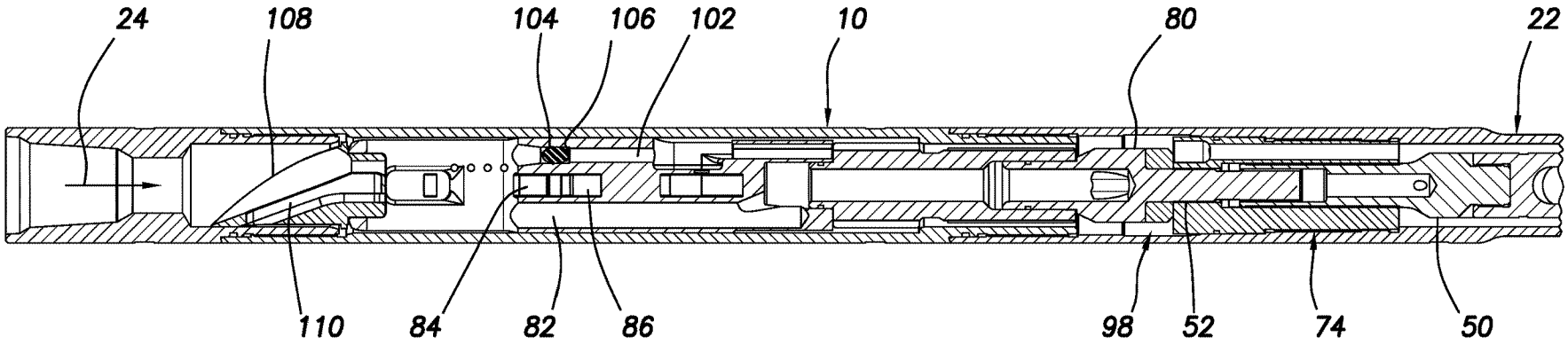
FIG. 63 is a representative cross-sectional view of the FIG. 62 fluid pulse generator.

Representatively illustrated in FIGS. 1-63 is a fluid pulse generator 10 and associated system 12 and method which can embody principles of this disclosure. However, it should be clearly understood that the pulse generator 10, system 12 and method are merely examples of applications of the principles of this disclosure in practice, and a wide variety of other examples are possible. Therefore, the scope of this disclosure is not limited at all to the details of the specific pulse generator 10, system 12 and method examples described herein and/or depicted in the drawings.

In one example, the fluid pulse generator 10 can include a fluid motor and a variable flow restrictor. The fluid motor includes a rotor configured to rotate in response to fluid flow through the fluid motor. The variable flow restrictor is positioned upstream of the fluid motor and includes a restrictor member rotatable by the rotor relative to a ported member to thereby variably restrict the fluid flow. The restrictor member is longitudinally displaceable relative to the rotor.

In another example of a fluid pulse generator 10, system 12 and method described below, as a rotary valve element is rotated by a fluid motor, a resistance to flow of a fluid is increased when a bypass flow path is blocked, and the resistance to flow of the fluid is decreased when the bypass flow path is unblocked. In some examples, the same fluid motor may be used to rotate a drill bit and actuate the fluid pulse generator. The fluid motor may rotate a rotary valve element upstream of the fluid motor.

In some examples, a flex joint or constant velocity joint may be connected between a rotor of the fluid motor and a rotary valve element or restrictor member. The flow of the fluid through the fluid pulse generator may be substantially restricted only during a minority of a cycle of rotation of a rotary valve element or restrictor member. A rotary valve element or restrictor member may be connected to a fluid motor rotor, and the rotary valve element or restrictor member may rotate relative to a ported member of the fluid pulse generator.

In another example described below, a fluid pulse generator 10, system 12 and method can include a fluidic restrictor element connected in parallel with a rotary valve assembly. The fluidic restrictor element and the rotary valve assembly may be upstream of a fluid motor. A rotary valve element of the rotary valve assembly may be rotated by a fluid motor.

The fluidic restrictor element may include a vortex chamber. A restriction to flow of fluid through the vortex chamber may alternately increase and decrease in response to the flow of the fluid through the vortex chamber. The creation of a vortex in the vortex chamber may be prevented when flow through a bypass flow path is unblocked.

Referring to FIG. 1, an example of the system 12 as used with a subterranean well is representatively illustrated. In this example, the pulse generator 10 is connected in a drill string 14 used to drill a wellbore 16 into an earth formation 18. For this purpose, the drill string 14 has a drill bit 20 connected at a distal end thereof.

Although the wellbore 16 is depicted in FIG. 1 as being vertical, in other examples the principles of this disclosure could be practiced in generally horizontal or inclined sections of the wellbore. Although the pulse generator 10 is depicted as being connected in the drill string 14, in other examples the pulse generator could be connected in other types of tubular strings (such as, an injection string, production string, completion string, etc.). Although a fluid motor 22 is depicted in FIG. 1 as being connected between and adjacent to the pulse generator 10 and drill bit 20, in other examples there could be other well tools (such as, logging tools, telemetry tools, stabilizers, centralizers, etc.) connected between these components. Thus, the scope of this disclosure is not limited to any particular details of the system 12 as depicted in FIG. 1.

In the FIG. 1 example, the drill bit 20 is rotated in order to advance the wellbore 16 into the formation 18. For this purpose, the drill string 14 includes the fluid motor 22 connected between the pulse generator 10 and the drill bit 20. The fluid motor 22 in this example is a Moineau-type fluid motor, and may also be referred to by those skilled in the art as a drilling motor or a "mud" motor. In other examples, other types of fluid motors (such as a turbine) may be used.

The fluid motor 22 rotates the drill bit 20 in response to flow of a fluid 24 through the drill string 14. The fluid 24 exits the drill string 14 via nozzles (not shown) in the drill bit 20, and then returns to surface via an annulus 26 formed between the wellbore 16 and the drill string.

In addition to rotating the drill bit 20, in this example the fluid motor 22 also rotates a restrictor member of the pulse generator 10, so that flow of the fluid 24 through the pulse generator is periodically obstructed or restricted. When the flow of the fluid 24 through the pulse generator 10 is substantially restricted, a portion of a momentum of the fluid 24 above the pulse generator is converted to elastic deformation of the drill string 14 above the pulse generator, resulting in elongation of that section of the drill string. When the flow of the fluid 24 through the pulse generator 10 is then substantially unrestricted, the section of the drill string 14 above the pulse generator longitudinally contracts. This alternating elongation and contraction of the drill string 14 can be used to facilitate advancement of the drill string through the wellbore 16, and can be particularly useful in advancing the drill string through highly deviated wellbores, although the scope of this disclosure is not limited to any particular purpose or function for which the pulse generator 10 is used.

In the FIG. 1 example, it is desired for the drill bit 20 to rotate continuously as the wellbore 16 is advanced through the formation 18, and flow of the fluid 24 through the fluid motor 22 is required to produce rotation by the fluid motor, so the pulse generator 10 is designed to continuously permit at least some fluid flow therethrough, even when the fluid flow is substantially obstructed or restricted. In addition, a rate of penetration is enhanced by permitting substantially unrestricted or unobstructed flow of the fluid 24 through the pulse generator 10 most of the time.

Referring additionally now to FIGS. 2-10, examples of the pulse generator 10 and fluid motor 22 are representatively illustrated. The pulse generator 10 and fluid motor 22 may be used in the system 12 and method of FIG. 1, or they may be used with other systems and methods.

Figure 2:
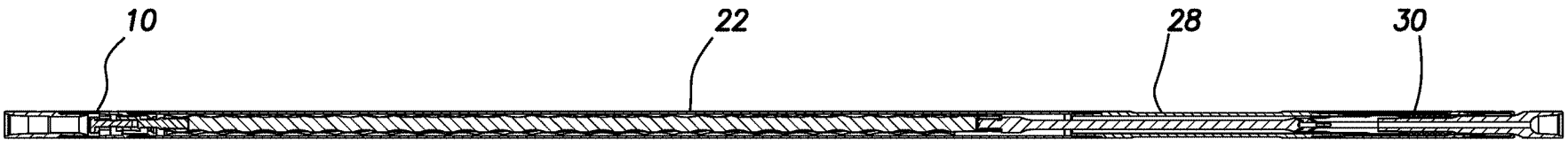
FIG. 2 is a representative cross-sectional view of an example of a fluid pulse generator and a fluid motor that may be used with the FIG. 1 system and method.
Figure 3:
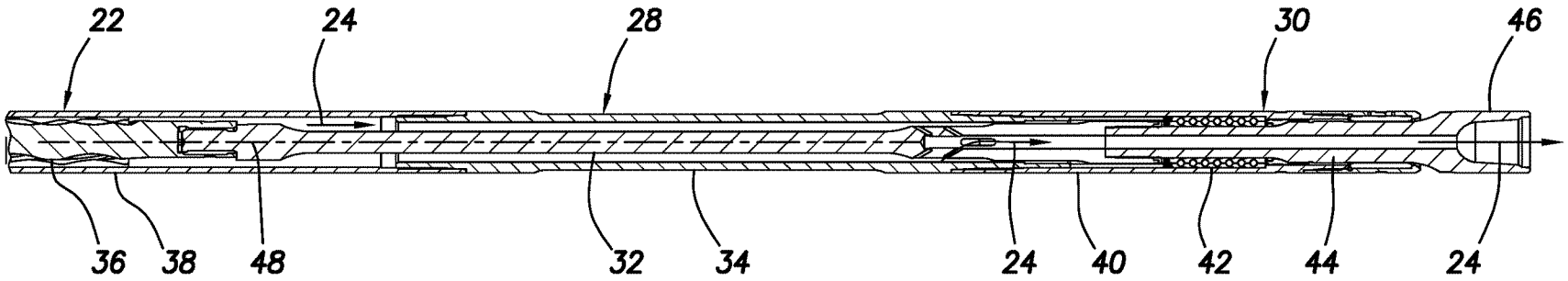
FIG. 3 is a representative cross-sectional view of an example of a flex joint section and a bearing section of the fluid motor.

In FIG. 2, the pulse generator 10 is depicted as being connected at an upper end of the fluid motor 22. In this example, the fluid motor 22 is provided with a flex joint section 28 and a bearing section 30. An example of the flex joint and bearing sections 28, 30 is representatively illustrated in FIG. 3.

The flex joint section 28 includes an elongated flexible rod or flex joint 32 positioned in a generally tubular outer housing 34. An upper end of the flex joint 32 is connected to a lower end of a rotor 36 of the fluid motor 22. The rotor 36 is positioned in an outer stator housing 38 of the fluid motor 22.

The bearing section 30 includes a generally tubular outer housing 40, bearings 42 and an inner mandrel 44 having a connector 46 at a lower end thereof. The bearings 42 support the inner mandrel 44 for rotation in the outer housing 40. An upper end of the inner mandrel 44 is connected to a lower end of the flex joint 32. The connector 46 extends outward from the outer housing 40 and, in this example, is configured for connection to the drill bit 20 (see FIG. 1).

The flow of the fluid 24 through the fluid motor 22 passes between an outer helical profile of the rotor 36 and an inner helical profile of the stator housing 38. This flow causes rotation of the rotor 36, as well as the flex joint 32 and the inner mandrel 44 connected thereto.

As the rotor 36 rotates, it also revolves about a central longitudinal axis 48 of the fluid motor 22. The upper end of the flex joint 32 rotates and revolves with the rotor 36 (a type of motion known as hypo-cyclic or epicyclic), but the lower end of the flex joint is restrained by its connection to the inner mandrel 44, so that the lower end only rotates about the axis 48. Thus, the flexibility of the flex joint 32 allows its upper end to rotate and revolve about the axis 48, while its lower end is constrained to only rotate about the axis 48.

Figure 4:
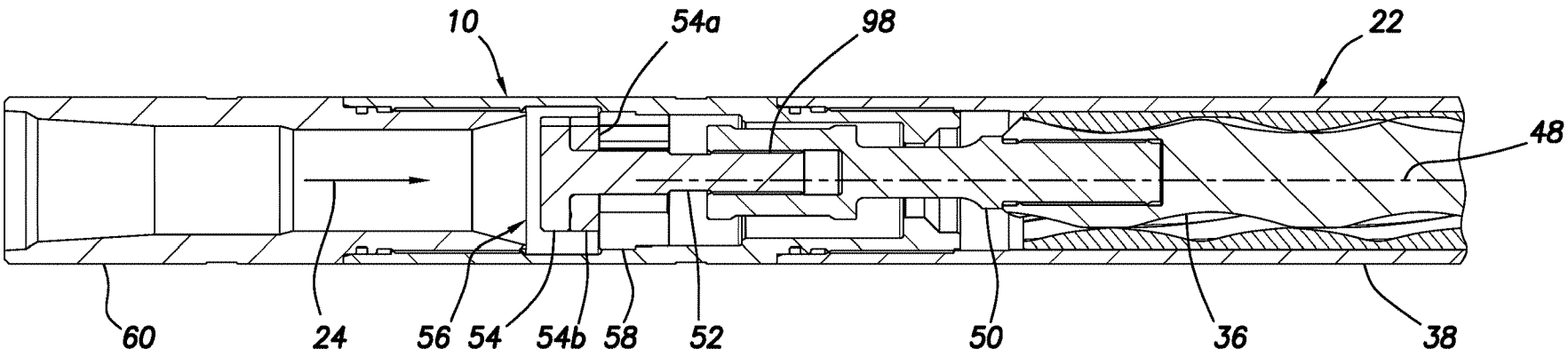
FIG. 4 is a representative cross-sectional view of an example of the fluid pulse generator.
Figure 5:
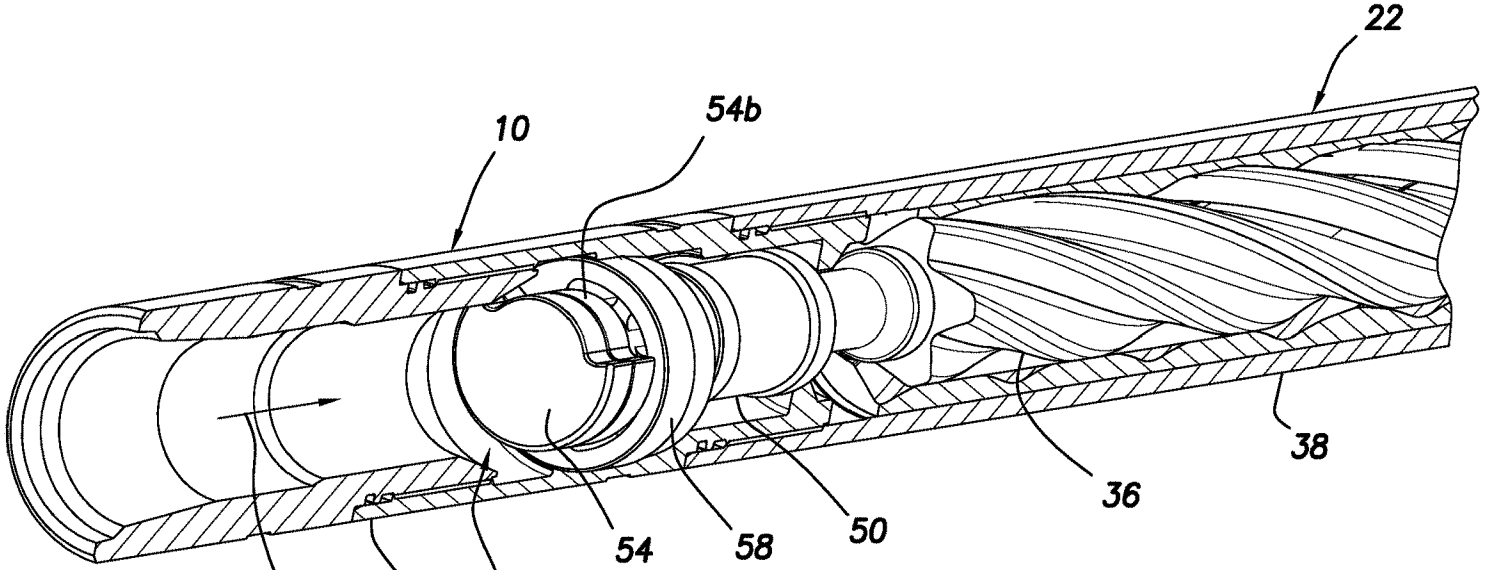
FIG. 5 is a representative perspective and partially cross-sectional view of the fluid pulse generator.
Figure 6:
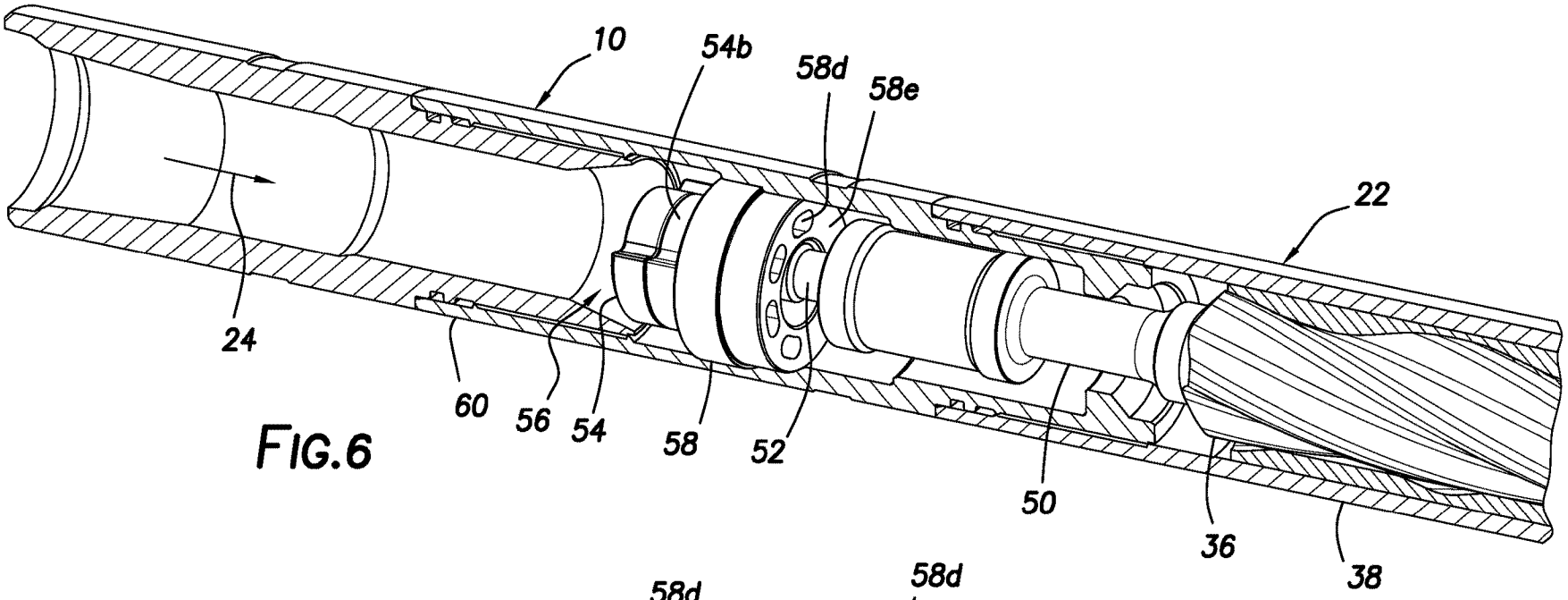
FIG. 6 is a representative perspective and partially cross-sectional view of the fluid pulse generator.

In FIGS. 4-6, various views of the pulse generator 10 connected at an upper end of the fluid motor 22 are representatively illustrated. In these views, it may be seen that the pulse generator 10 includes an inner mandrel 50 rigidly connected at an upper end of the rotor 36. Thus, the inner mandrel 50 rotates and revolves with the rotor 36 about the central axis 48. In some examples, the inner mandrel could be integrally formed with the rotor 36.

An upper end of the inner mandrel 50 is internally splined. A shaft 52 of a restrictor member 54 is externally splined, and is slidingly received in the upper end of the inner mandrel 50. The splined longitudinally variable length connection 98 between the inner mandrel 50 and the restrictor member shaft 52 permits rotation and torque to be transmitted from the rotor 36 to the restrictor member 54, while providing for a variable longitudinal distance between the rotor and the restrictor member.

Other types of variable length connections may be used to transmit rotation and torque from the rotor 36 to the restrictor member 54. For example, a key carried on the shaft 52 or in the inner mandrel 50 could be slidingly engaged in a longitudinally extending slot formed in the other of them. Thus, the scope of this disclosure is not limited to use of any particular type of variable length connection.

The restrictor member 54 is a component of a variable flow restrictor 56 of the pulse generator 10. The variable flow restrictor 56 variably restricts or obstructs the flow of the fluid 24 through the pulse generator 10. The variable flow restrictor 56 in this example includes the restrictor member 54 and a ported member 58.

The variable length connection 98 between the inner mandrel 50 and the restrictor member shaft 52 allows the flow of the fluid 24 to bias the restrictor member 54 against an upper face of the ported member 58. This surface contact between the restrictor member 54 and the ported member 58 facilitates generation of desired variations in the flow of the fluid 24 by restricting leakage of fluid between contacting surfaces of the restrictor member and ported member.

The pulse generator 10 includes an outer housing assembly 60 that contains the variable flow restrictor 56 and an upper portion of the inner mandrel 50. The outer housing assembly 60 is connected to the stator housing 38 of the fluid motor 22.

Rotation of the restrictor member 54 relative to the ported member 58 by the rotor 36 causes the restriction to flow of the fluid 24 through the pulse generator 10 to repeatedly vary between substantially unrestricted and substantially restricted configurations. In other examples, the ported member 58 could be rotated relative to the restrictor member 54 in order to vary the restriction to fluid flow. Thus, the scope of this disclosure is not limited to rotation by the rotor 36 of any specific member of the variable flow restrictor 56.

In FIGS. 7-10, an example of the restrictor member 54 and the ported member 58 are representatively illustrated, apart from the rest of the pulse generator 10. In these views, it may be seen that this example of the restrictor and ported members 54, 58 are uniquely configured to provide for substantially unrestricted flow of the fluid 24 through the pulse generator 10 during a majority of a rotation cycle, and to provide for substantially restricted flow only during a small minority of the rotation cycle.

Figure 7:
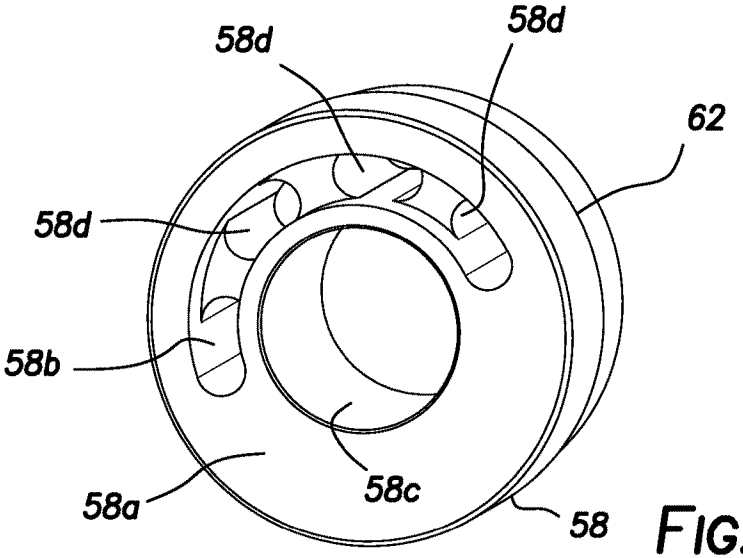
FIG. 7 is a representative perspective view of an example of a ported member of the fluid pulse generator.

In FIG. 7, it may be seen that the ported member 58 has an external shoulder 62 formed thereon. The shoulder 62 abuts an internal shoulder in the outer housing assembly 60, so that the ported member 58 is prevented from displacing longitudinally past the internal shoulder. In some examples, the ported member 58 could be press-fit or otherwise secured in the outer housing assembly 60, in order to prevent relative rotation between the ported member and the outer housing assembly.

An upper face **58*a* of the ported member 58 has a semi-circular groove or recess 58*b* formed therein. In some examples, the recess 58*b* may extend greater than 180 degrees about a central bore 58*c* formed through the ported member 58. Multiple ports 58*d* extend between the recess 58*b* and a lower face 58*e* (see FIG. 6) of the ported member 58. The ports 58*d* permit fluid communication between the recess 58*b* in the pulse generator 10 and the fluid motor 22 below (downstream of) the variable flow restrictor 56**.

Figure 8:
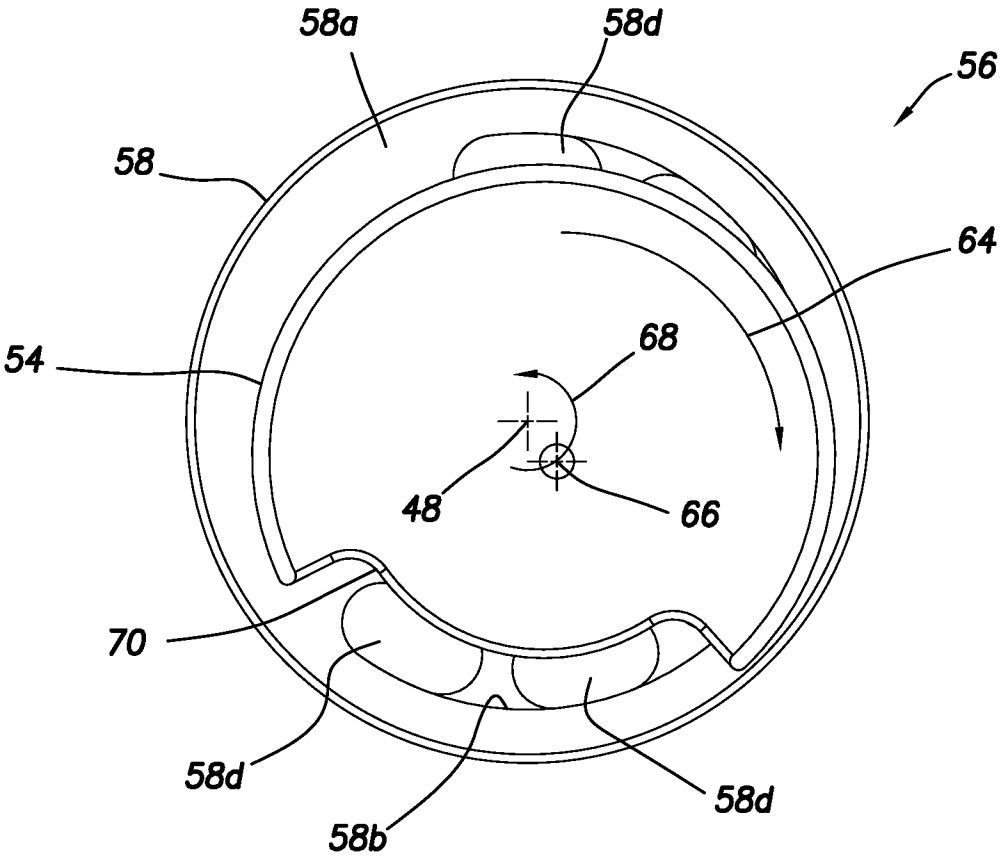
FIG. 8 is a representative top view of an example of a restrictor member and the ported member in a partially restricted configuration.

In FIG. 8, it may be seen that the restrictor member 54 only partially overlaps the upper face **58*a* of the ported member 58. When any of the recess 58*b* is not blocked by the restrictor member 54, the recess allows the fluid 24 to flow through all of the ports 58*d*. Thus, the restriction to flow of the fluid 24 through the variable flow restrictor 56 is dependent on how much of the recess 58*b* is blocked by the restrictor member 54**.

FIG. 8 also depicts an example of how the restrictor member 54 rotates and revolves relative to the ported member 58. The restrictor member 54 rotates about its longitudinal axis 66 in a clockwise direction viewed from above, as indicated by arrow 64. The rotor 36 and inner mandrel 50 also rotate in this direction. The restrictor member 54 revolves about the central axis 48 in a counterclockwise direction viewed from above, as indicated by arrow 68. The rotor 36 and inner mandrel 50 also revolve about the axis 48 in this direction. In other examples, the restrictor member 54 could rotate about its longitudinal axis 66 in a counterclockwise direction and the restrictor member could revolve about the central axis 48 in a clockwise direction.

An upper section of the restrictor member 54 is generally cylindrical shaped, but it has a circumferentially extending recess 70 formed in a section of its outer circumference. In this example, the recess 70 extends less than 180 degrees about the outer circumference of the restrictor member 54.

Figure 10:
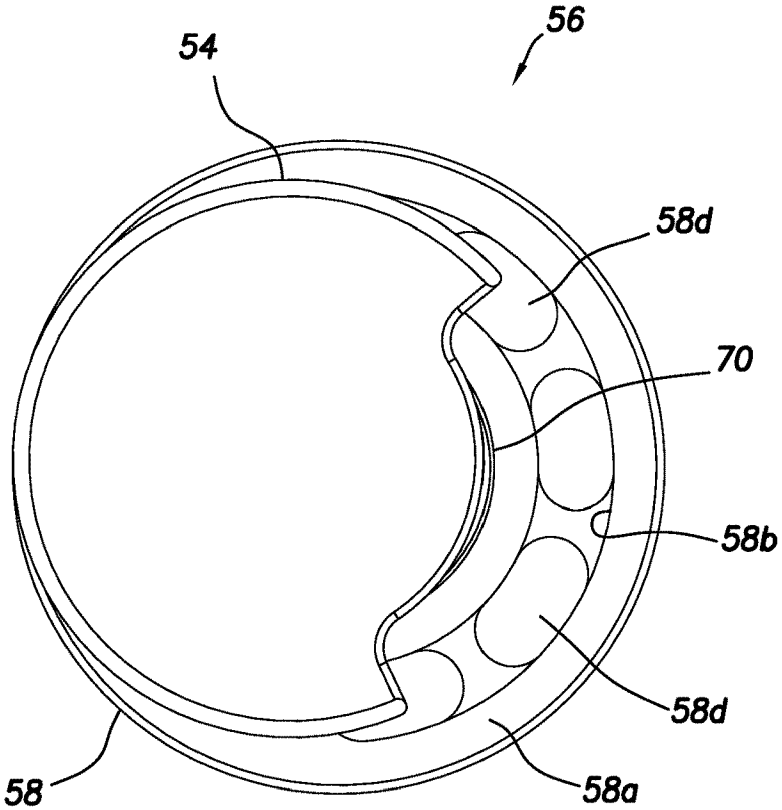
FIG. 10 is a representative top view of the restrictor member and the ported member in a substantially unrestricted configuration.
Figure 9:
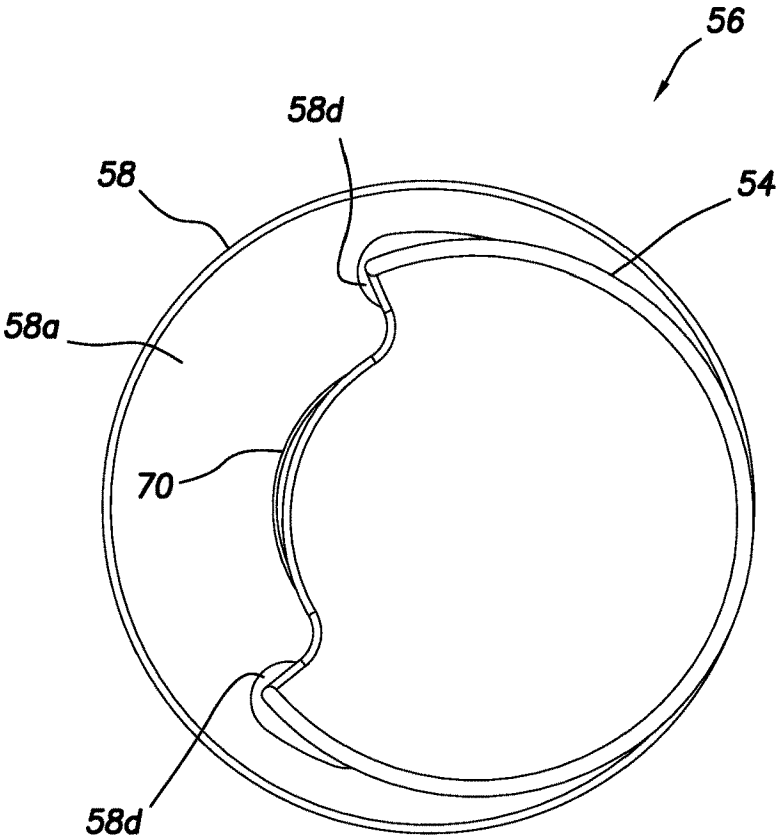
FIG. 9 is a representative top view of the restrictor member and the ported member in a substantially restricted configuration.

In FIGS. 9 & 10, the variable flow restrictor 56 is depicted in respective maximally and minimally restricted or obstructed configurations. In FIG. 9, it may be seen that the restrictor member 54 is in a position in which it obstructs a large majority of a flow area through the upper face 58*a* of the ported member 58. In this position, flow of the fluid 24 through the variable flow restrictor 56 is at a minimum.

In FIG. 10, it may be seen that the restrictor member 54 is in a position in which a large majority of the flow area through the upper face 58*a* of the ported member 58 is not obstructed by the restrictor member. In this position, flow of the fluid 24 through the variable flow restrictor 56 is at a maximum.

Figure 11:
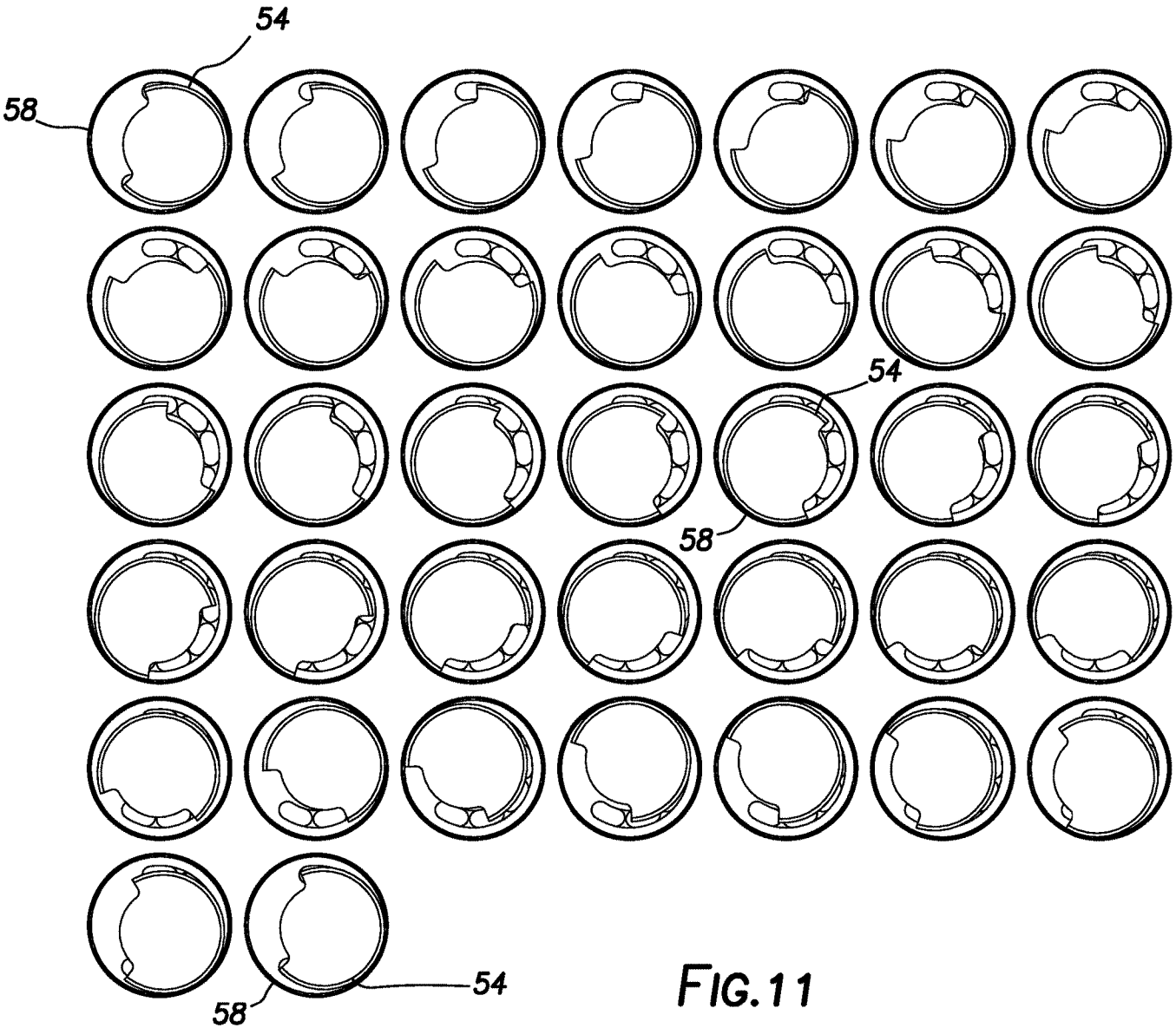
FIG. 11 comprises representative top views of the restrictor member and the ported member in a succession of configurations making up a complete cycle.
Figure 12:
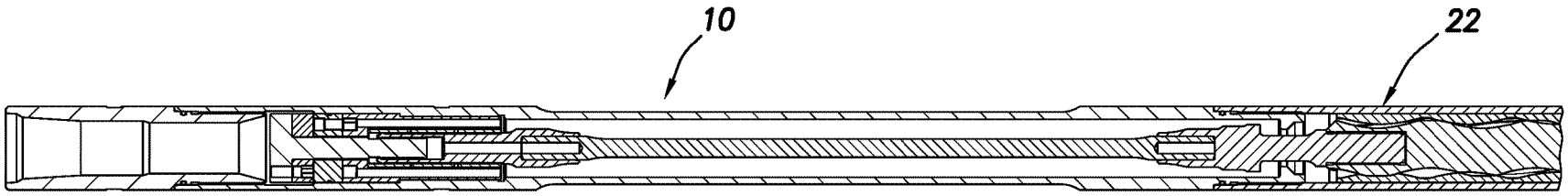
FIG. 12 is a representative cross-sectional view of another example of the fluid pulse generator and an upper portion of the fluid motor.
Figure 13:
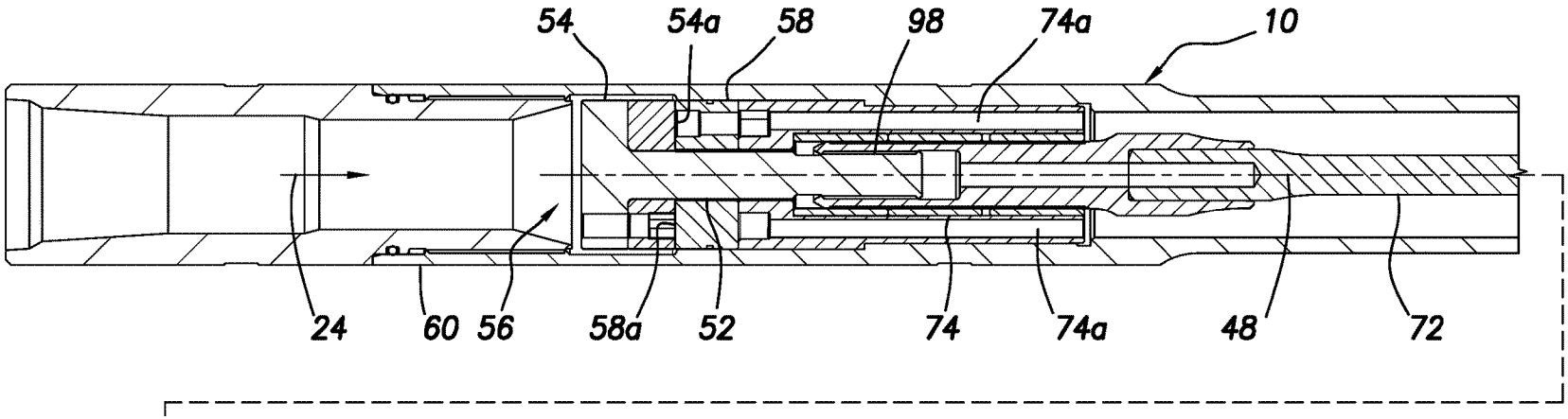
FIG. 13 is a representative cross-sectional view of the FIG. 12 fluid pulse generator.
Figure 13:
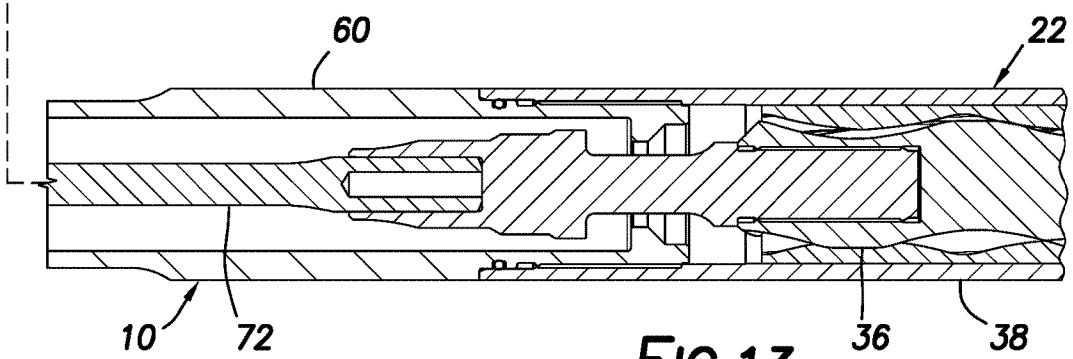
Figure 14:
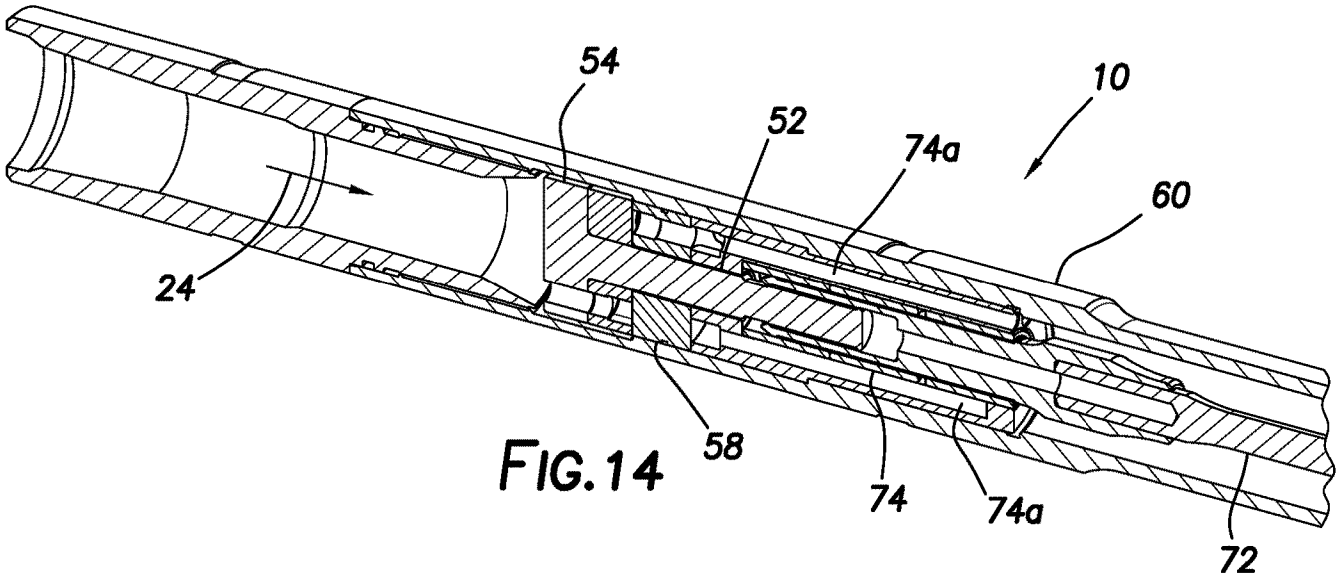
FIG. 14 is a representative cross-sectional and perspective view of the FIG. 12 fluid pulse generator.
Figure 15:
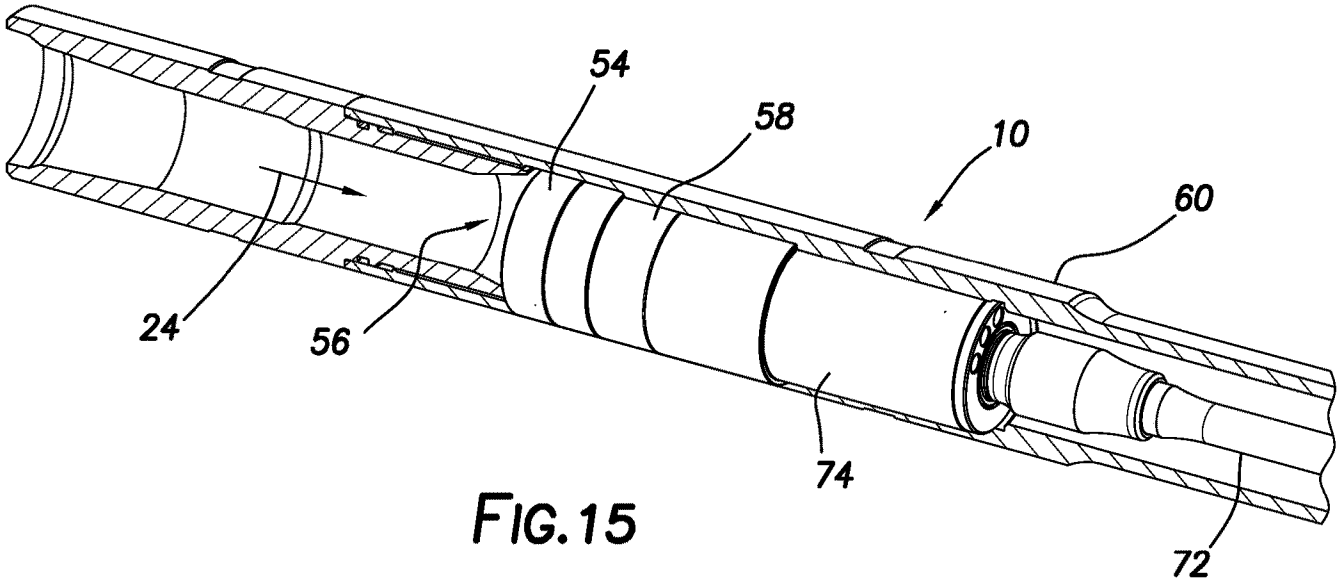
FIG. 15 is a representative partially cross-sectional and perspective view of the FIG. 12 fluid pulse generator.

Referring additionally now to FIG. 11, a sequence of positions of the restrictor member 54 relative to the ported member 58 for a complete 360 degree rotation of the restrictor member are representatively illustrated. Note that the restrictor member 54 in this example displaces from the maximally restricted configuration to the minimally restricted configuration, and then back to the maximally restricted configuration, over a full cycle comprising 360 degrees of rotation.

Note that it is desirable in this example for a lower face 54*a* of the restrictor member 54 (see FIG. 4) to be in contact with the upper face 58*a* of the of the ported member 58 for effective variation of the restriction to flow through the variable flow restrictor 56. Preferably, the restrictor member 54 and ported member 58 are made of durable erosion resistant and wear resistant materials, or at least the lower face 54*a* and upper face 58*a* comprise such materials.

Note, also, that the flow of the fluid 24 through the variable flow restrictor 10 tends to bias the restrictor member 54 against the ported member 58, thereby increasing a bearing stress between the lower face 54*a* and the upper face 58*a*. The splined connection 98 between the shaft 52 and the inner mandrel 50 permits the restrictor member 54 to displace in the direction of the flow.

In the FIGS. 2-11 example, the restrictor member 54 includes a lower portion 54*b* that is made of a carbide material. An upper portion of the ported member 58 could similarly be made of a carbide material. Alternatively, the lower and upper faces 54*a*, 58*a* could have a hard facing material applied to them using any of a variety of different processes. Any technique for preventing or reducing wear between the faces 54*a*, 58*a* may be used in keeping with the principles of this disclosure.

Alternatively, one of the faces 54*a*, 58*a* could be made of a material that is designed to gradually wear away as the variable flow restrictor 56 is operated downhole. In this alternative, the face 54*a* or 58*a* could be replaced after it is sufficiently worn (perhaps after each use).

Referring additionally now to FIGS. 12-17, another example of the pulse generator 10 is representatively illustrated. In this example, the restrictor member 54 rotates about the central axis 48, but does not revolve about the central axis (e.g., in a hypo-cyclic or epicyclic motion) as in the FIGS. 2-11 example.

In the FIGS. 12-17 example, a flex joint 72 is used in place of the inner mandrel 50. The flex joint 72 is connected at its upper end to the restrictor member 54 using a splined or other longitudinally variable distance connection 98, and is connected at its lower end to the upper end of the rotor 36. The flex joint 72 in this example can be made of a titanium material with pressed-on steel end portions. However, the scope of this disclosure is not limited to use of any particular materials for any particular components of any of the variable flow restrictor examples described herein.

The lower end of the flex joint 72 rotates and revolves with the rotor 36 about the central axis 48. However, a flexibility of the flex joint 72 allows the upper end of the flex joint to be constrained by a bearing assembly 74, so that it only rotates about the central axis 48. Note that ports 74*a* are formed through the bearing assembly 74 to provide for flow of the fluid 24 through the bearing assembly.

Figure 16:
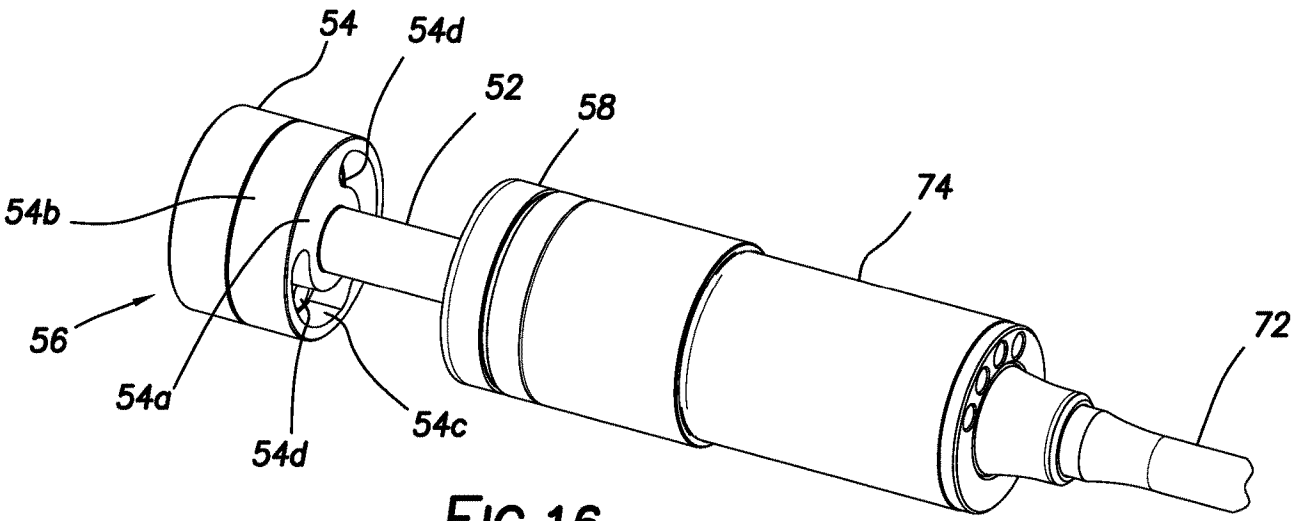
FIG. 16 is a representative perspective view of a restrictor member, ported member, bearing assembly and flex joint of the FIG. 12 fluid pulse generator.
Figure 17:
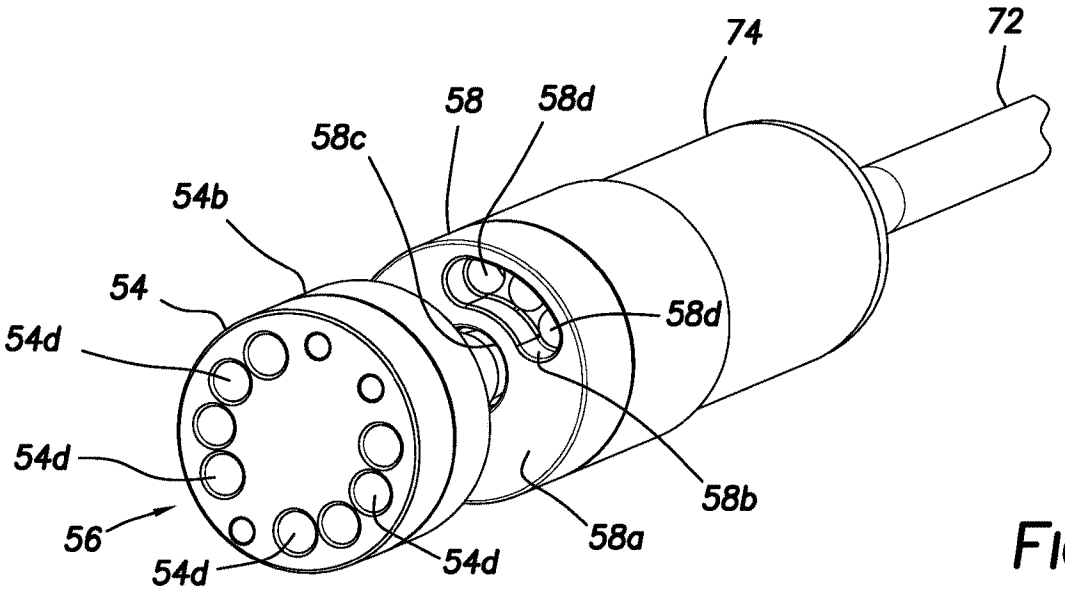
FIG. 17 is a representative perspective view of the restrictor member, ported member, bearing assembly and flex joint of the FIG. 12 fluid pulse generator.

In FIGS. 16 & 17, it may be seen that the restrictor member 54 has a recess 54*c* formed in the lower face 54*a*, and multiple ports 54*d* extending through the restrictor member. In this example, the recess 54*c* extends more than 180 degrees about the shaft 52, whereas the recess 58*b* in the upper face 58*a* extends less than 180 degrees about the central bore 58*c*. The restriction to flow of the fluid 24 through the variable flow restrictor 56 is determined by how much the recesses 54*c*, 58*b* overlap as the restrictor member 54 rotates relative to the ported member 58.

Figure 18:
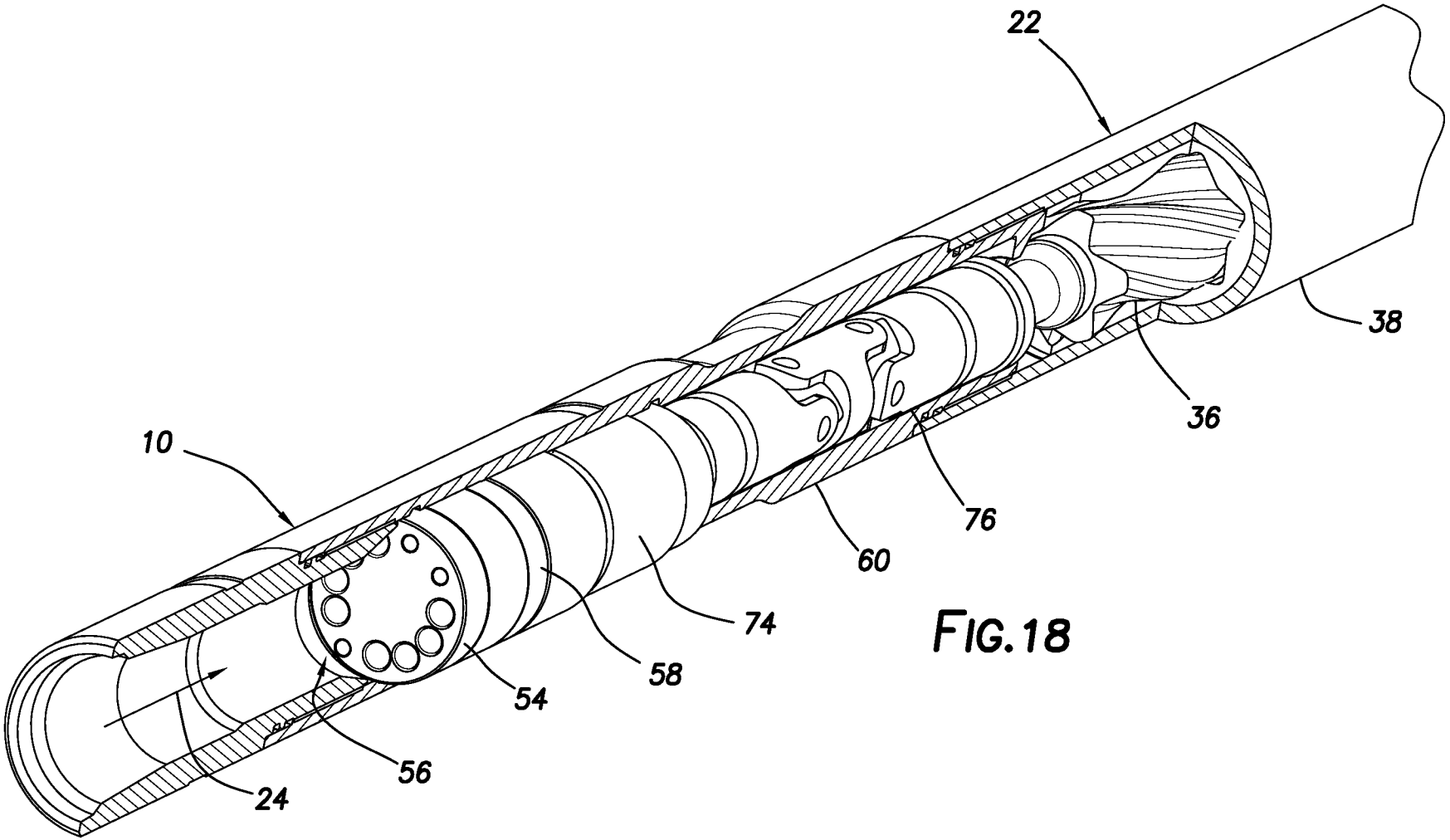
FIG. 18 is a representative perspective and partially cross-sectional view of another example of the fluid pulse generator and an upper portion of the fluid motor.
Figure 19:
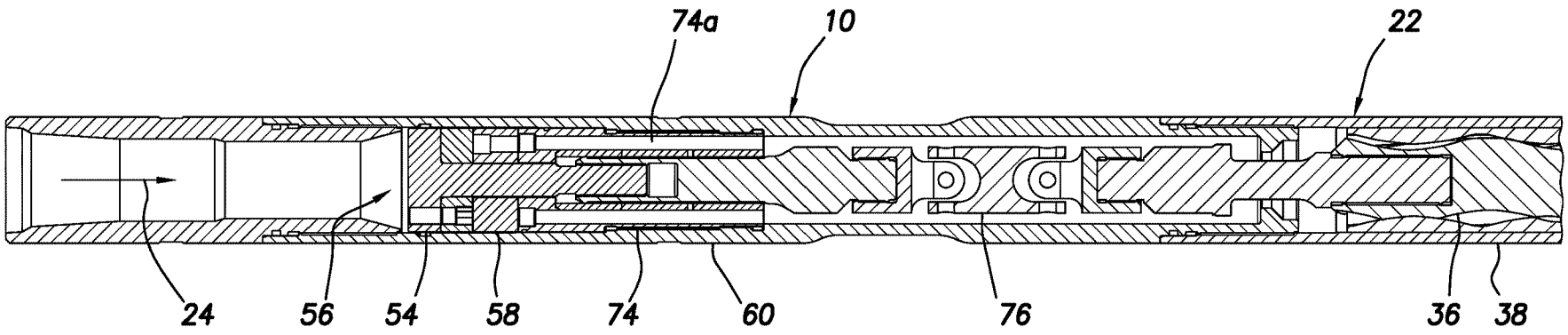
FIG. 19 is a representative cross-sectional view of the FIG. 18 fluid pulse generator and the upper portion of the fluid motor.

Referring now to FIGS. 18 & 19, another example of the pulse generator 10 is representatively illustrated. In this example, a universal joint or constant velocity joint assembly 76 is connected between the rotor 36 and the restrictor member 54 in place of the flex joint 72 of the FIGS. 12-17 example.

The lower end of the joint assembly 76 rotates and revolves with the rotor 36 about the central axis 48. However, the joint assembly 76 allows the upper end of the joint assembly to be constrained by the bearing assembly 74, so that it only rotates about the central axis 48. Operation of the FIGS. 18 & 19 example is substantially similar to the operation of the FIGS. 12-17 example.

Referring now to FIGS. 20-32, another example of the pulse generator 10 is representatively illustrated. In this example, the variable flow restrictor 56 is configured so that the restrictor member 54 rotates within the ported member 58.

The restrictor member 54 is press-fit or otherwise secured onto an upper end of the flex joint 72, which is connected between the restrictor member and the rotor 36. In other examples, the constant velocity joint 76 may be used in place of, or in addition to, the flex joint 72.

Figure 20:
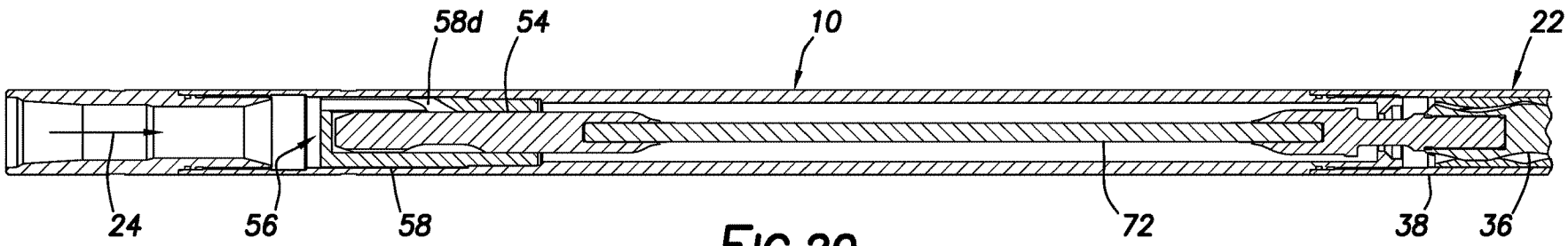
FIG. 20 is a representative cross-sectional view of another example of the fluid pulse generator and an upper portion of the fluid motor.
Figure 21:
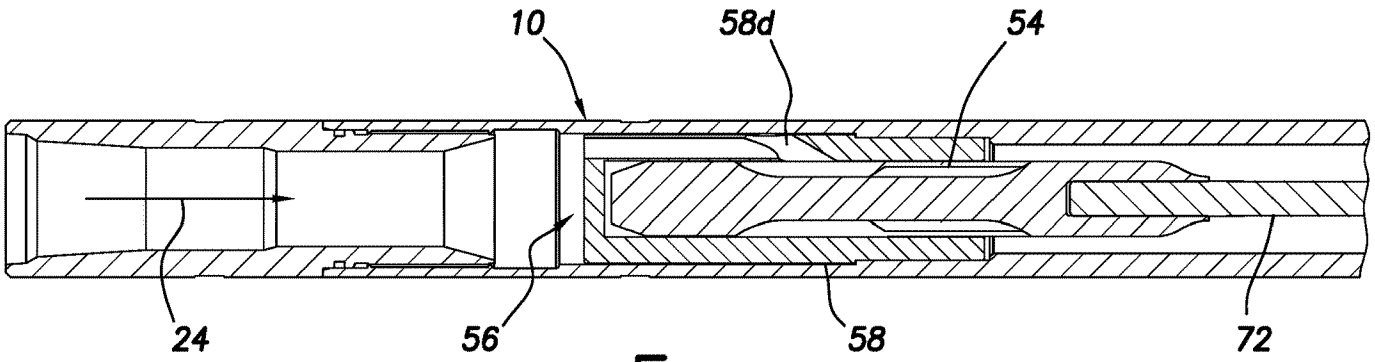
FIGS. 21 & 22 are representative cross-sectional views of the FIG. 20 fluid pulse generator in respective substantially unrestricted and substantially restricted configurations.
Figure 22:
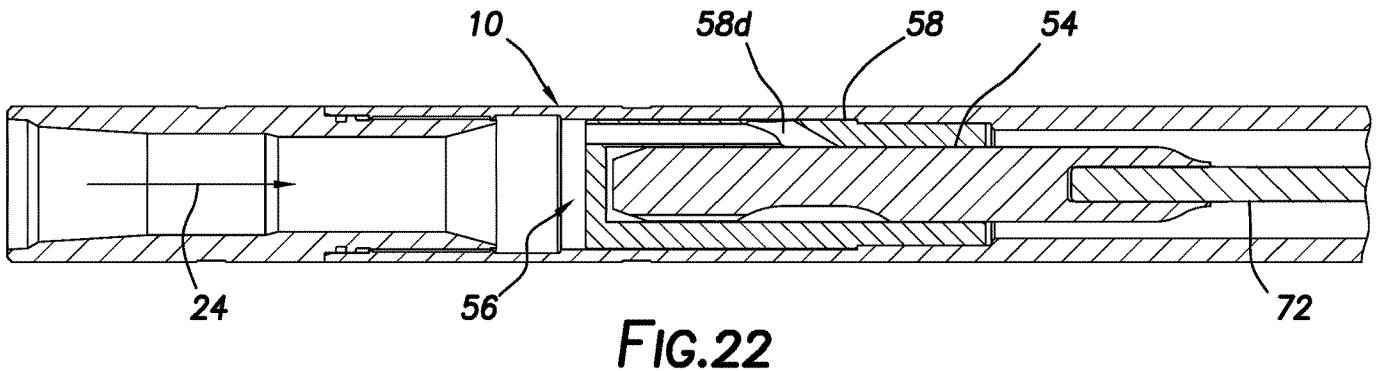
Figure 23:
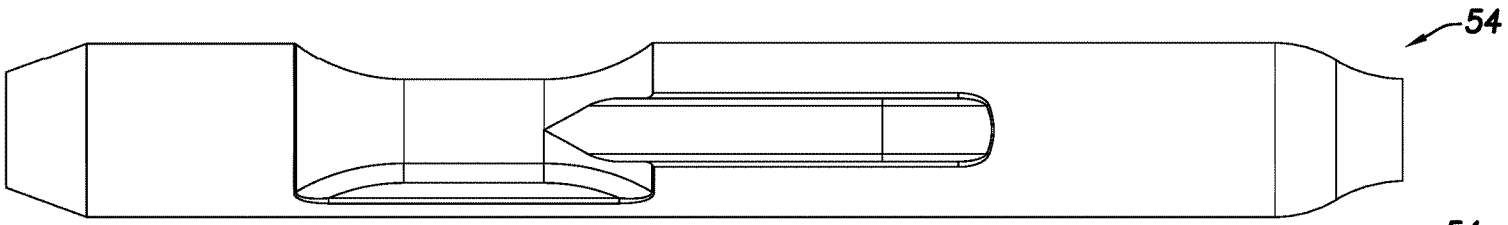
FIGS. 23-32 are representative side and perspective views of a restrictor member of the FIG. 20 fluid pulse generator.
Figure 24:
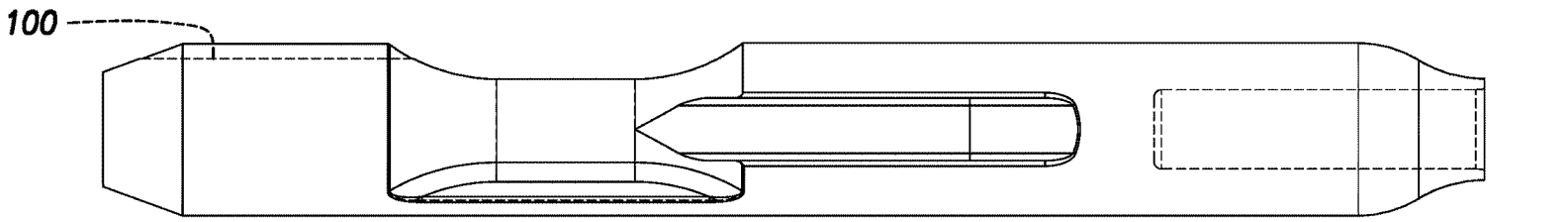
Figure 25:
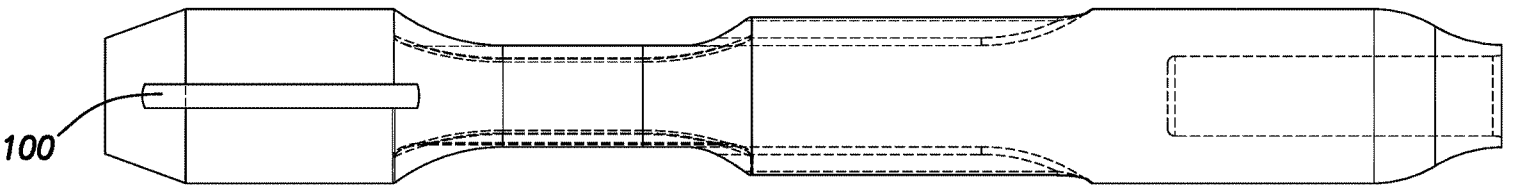
Figure 26:
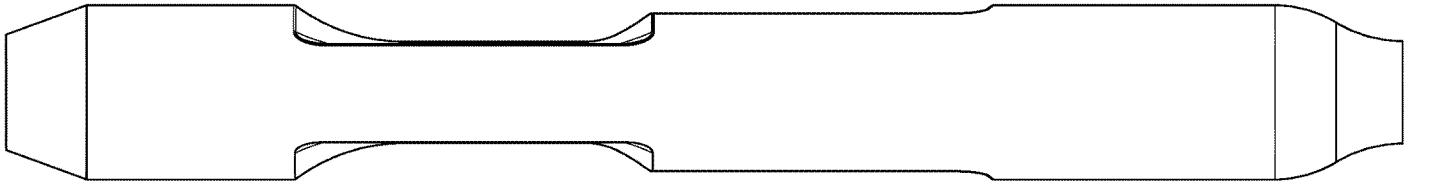
Figure 27:
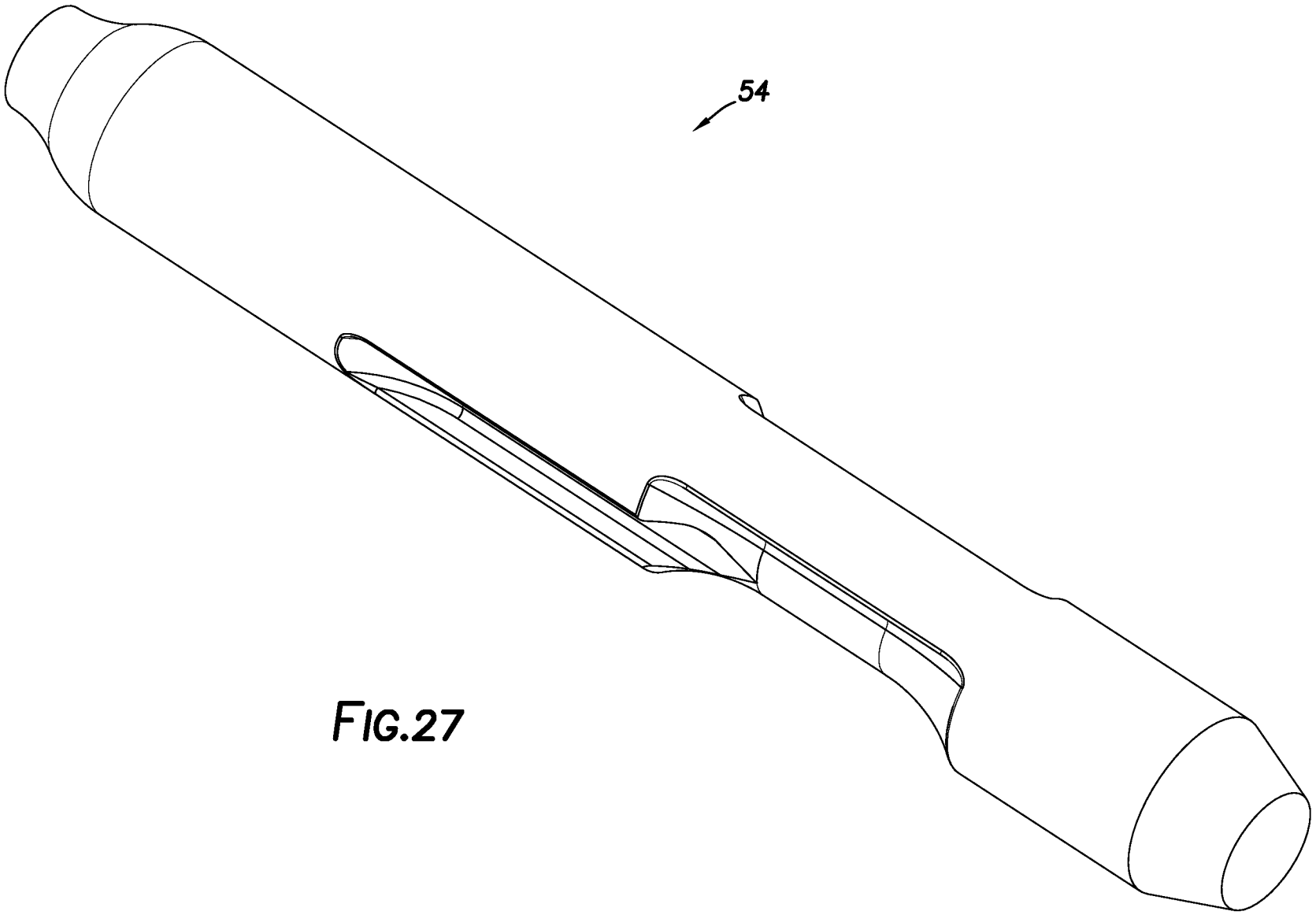
Figure 28:
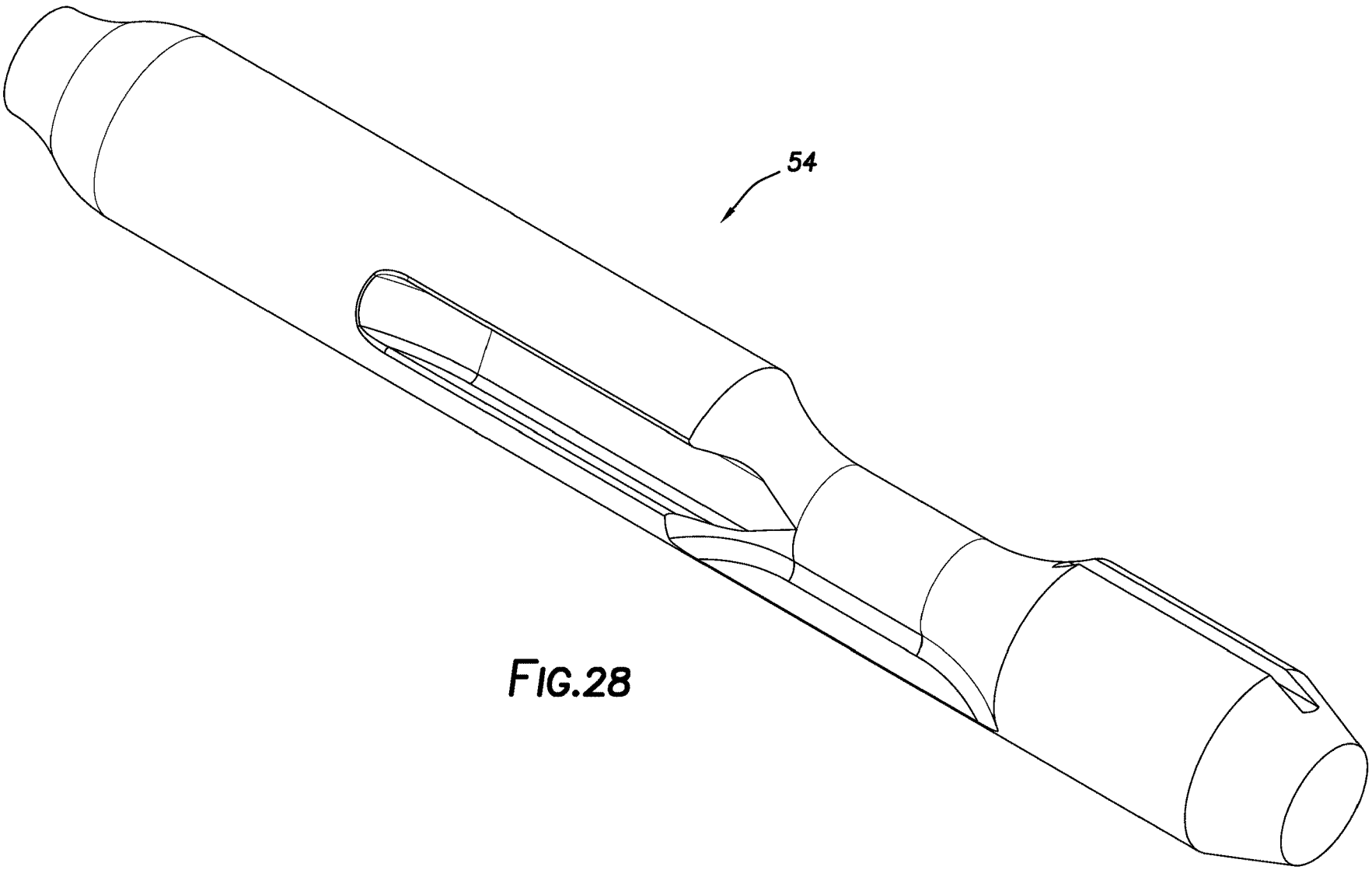
Figure 29:
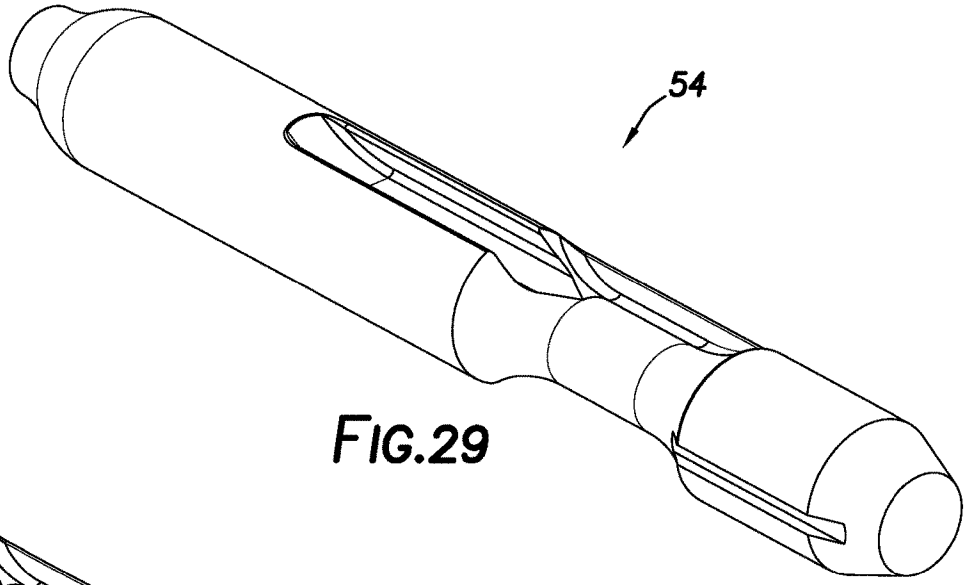
Figure 31:
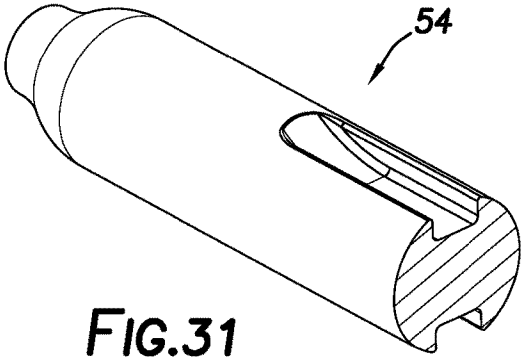
Figure 30:
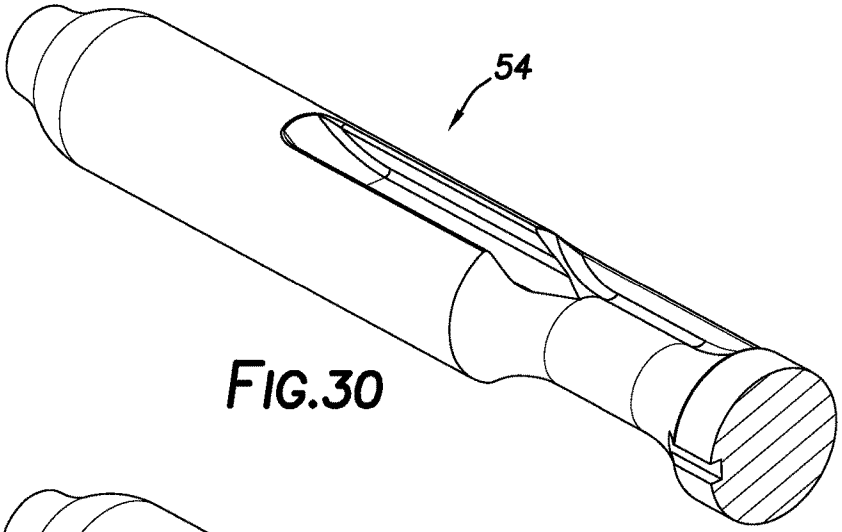
Figure 32:
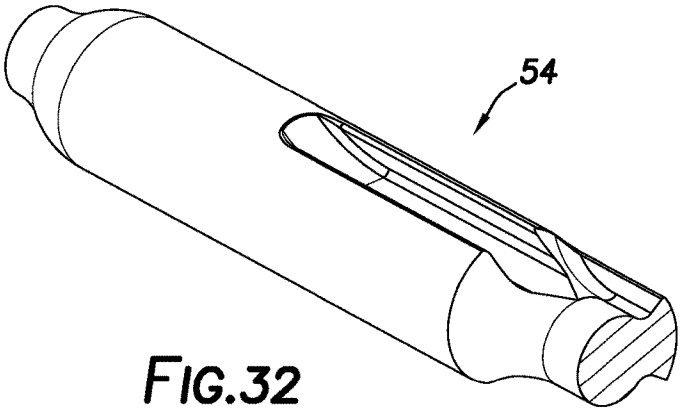

As depicted in FIGS. 20-22, the restrictor member 54 is received in the ported member 58. An upper end of the ported member 58 is closed off, except that a passageway and/or port 58*d* extends through a side wall of the ported member. The port 58*d* allows the fluid 24 to flow to an interior of the ported member 58.

The restrictor member 54 periodically obstructs the port 58*d*, thereby restricting the flow of the fluid 24 through the variable flow restrictor 56. As depicted in FIG. 21, the restrictor member 54 is rotated to a position in which the port 58*d* is not obstructed by the restrictor member, and so maximum flow of the fluid 24 through the variable flow restrictor 56 is permitted. In FIG. 22, the restrictor member 54 is rotated to a position in which the port 58*d* is most obstructed by the restrictor member, and so minimal flow of the fluid 24 through the variable flow restrictor 56 is permitted.

FIGS. 23-32 depict various views of the restrictor member 54. In these views, it may be seen that the restrictor member 54 is configured to permit relatively unobstructed flow of the fluid 24 through the variable flow restrictor 56 during most of the rotation of the restrictor member.

Flow of the fluid 24 is substantially restricted by the variable flow restrictor 56 only during a small portion of the rotation of the restrictor member 54 relative to the ported member 58. A relatively small recess or channel 100 formed in an upper portion of the restrictor member 54 allows a small amount of the fluid to flow through the fluid pulse generator 10, even when the restrictor member obstructs the port 58*d*.

Note that the splined connection 98 is not used in the FIGS. 20-32 example. However, the restrictor member 54 can longitudinally displace somewhat relative to the ported member 58, for example, to accommodate longitudinal displacement of the rotor 36 relative to the stator housing 38.

Figure 60:
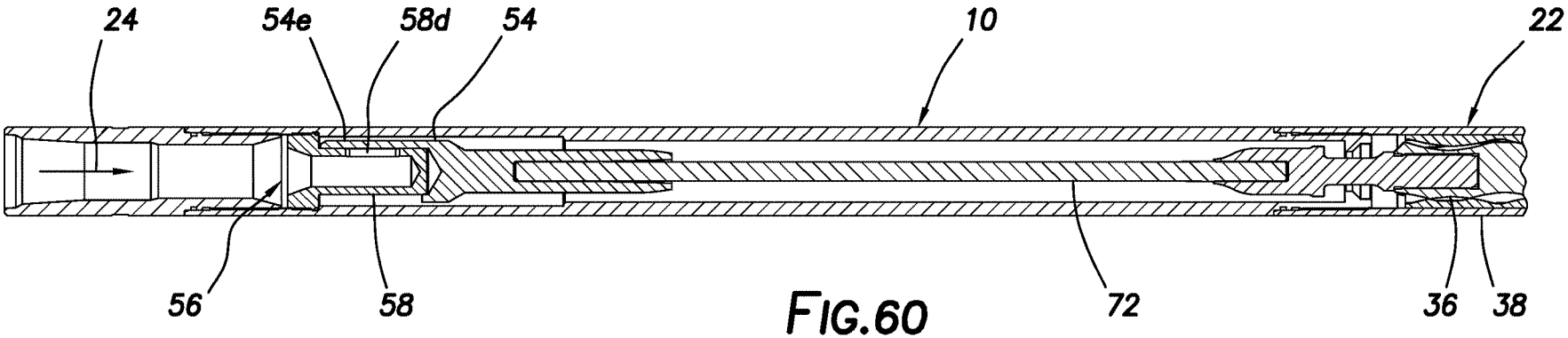
FIG. 60 is a representative cross-sectional view of another example of the fluid pulse generator and an upper portion of the fluid motor.
Figure 61B:
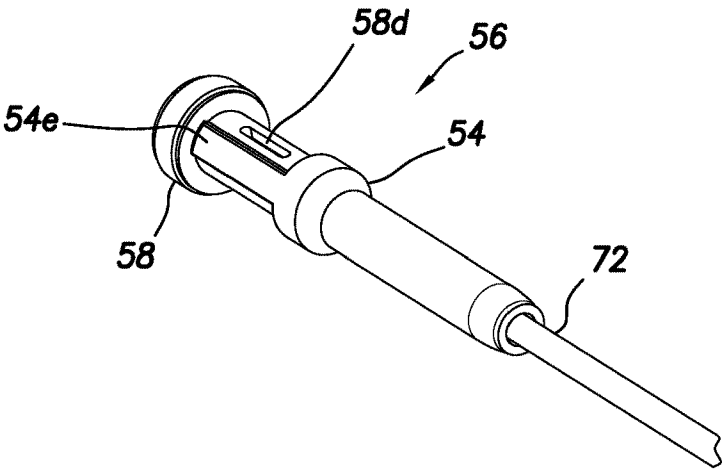
FIGS. 61A & B are representative perspective views of the restrictor member of the FIG. 60 fluid pulse generator in respective substantially restricted and substantially unrestricted configurations.

Another example of the fluid pulse generator 10 is representatively illustrated in FIGS. 60-61B. In this example, the restrictor member 54 is rotated externally to (e.g., circumferentially about) the ported member 58. The restrictor member 54 includes an extension 54*e* that obstructs or blocks flow through the port 58*d* in the ported member 58, but only in a minority of a cycle of rotation of the restrictor member.

Figure 61A:
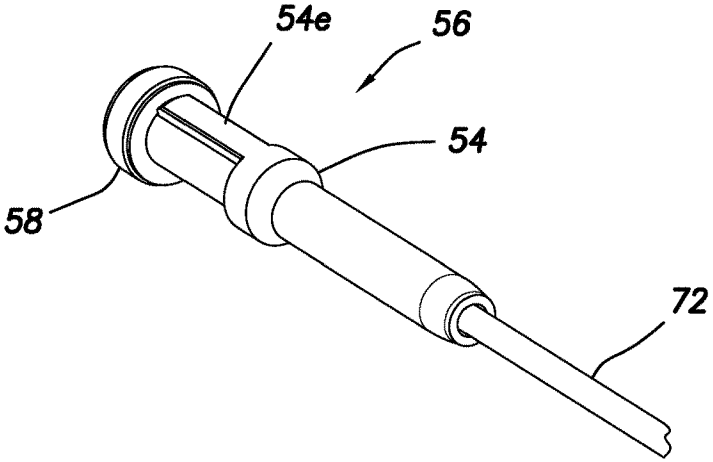

The restrictor member extension 54*e* periodically obstructs the port 58*d*, thereby restricting the flow of the fluid 24 through the variable flow restrictor 56. As depicted in FIG. 61A, the restrictor member 54 is rotated to a position in which the port 58*d* is obstructed by the restrictor member extension 54*e*, and so minimal flow of the fluid 24 through the variable flow restrictor 56 is permitted. In FIG. 61B, the restrictor member 54 is rotated to a position in which the port 58*d* is not obstructed by the restrictor member extension 54*e*, and so maximum flow of the fluid 24 through the variable flow restrictor 56 is permitted.

Referring additionally now to FIGS. 33-49, another example of the fluid pulse generator 10 and system 12 is representatively illustrated. In this example, the fluid motor 22 drives a valve 80 that alternately prevents and permits flow through a bypass flow path 82. The bypass flow path 82 is in parallel with a flow path 84 through a fluidic restrictor element 86.

The fluidic restrictor element 86 may comprise any fluidic device capable of restricting fluid flow in response to the fluid flow through the fluidic device. Examples of suitable fluidic devices are described in U.S. Pat. Nos. 8,381,817, 8,439,117, 8,453,745, 8,517,105, 8,517,106, 8,517,107, 8,517,108, 9,212,522, 9,316,065, 9,915,107, 10415324 and 10513900. The entire disclosures of these US patents are incorporated herein by this reference.

Figure 33:
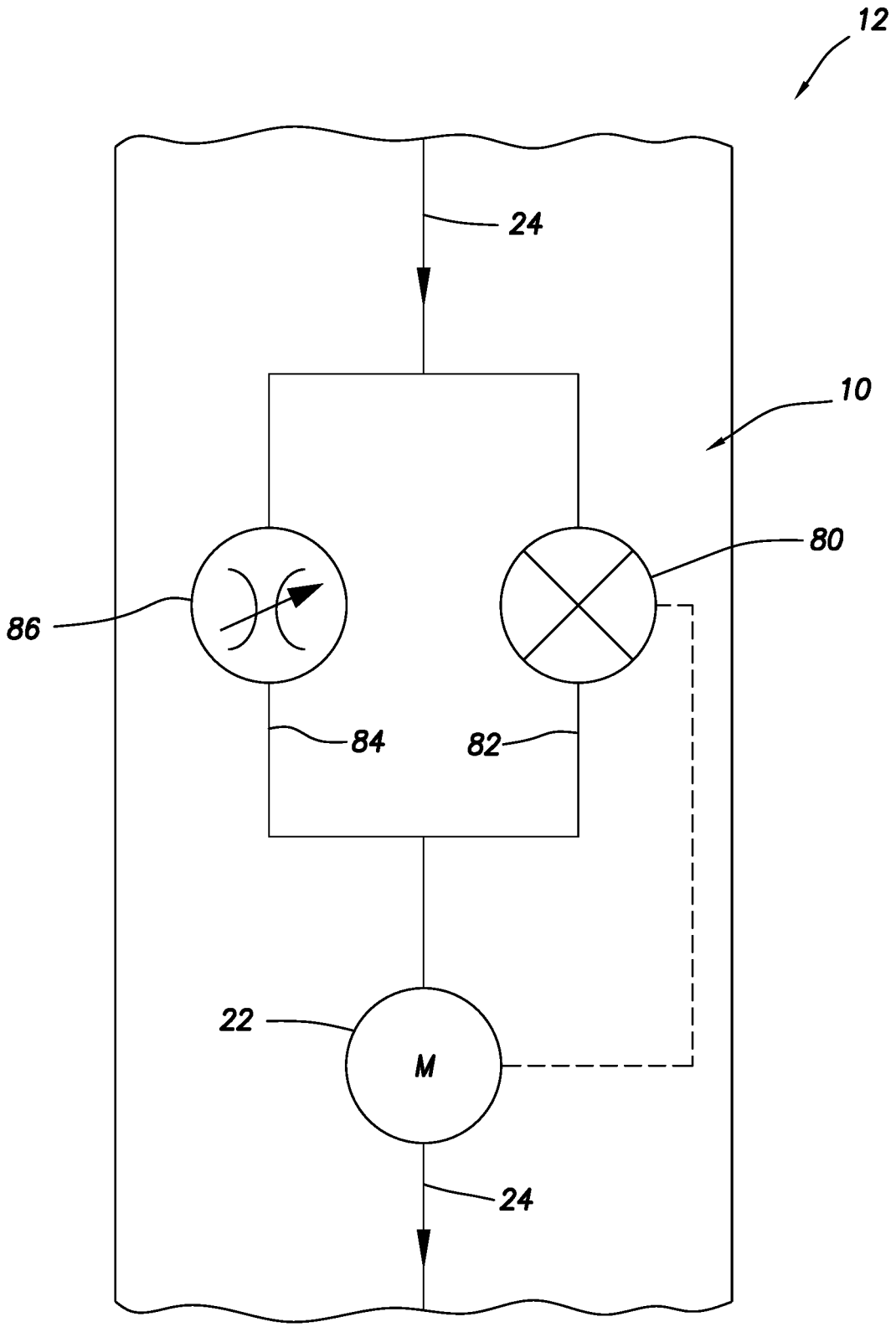
FIG. 33 is a representative schematic view of another example of the system and method.

As depicted in FIG. 33, the fluid 24 can flow into both of the valve 80 and the fluidic restrictor element 86. When the valve 80 is open, the fluid 24 will preferentially flow through the bypass flow path 82, since it presents less resistance to the flow of the fluid 24. When the valve 80 is closed, the fluid 24 is forced to flow through the fluidic restrictor element 86, thereby variably restricting the flow of the fluid 24 through the fluidic restrictor element 86.

Note that flow of the fluid 24 is continually permitted through the fluidic restrictor element 86 and so, even when the valve 80 is closed, the fluid 24 still flows through the fluid motor 22. Thus, the fluid motor 22 can continue to drive the valve 80, whether the valve is open or closed.

Figure 34:
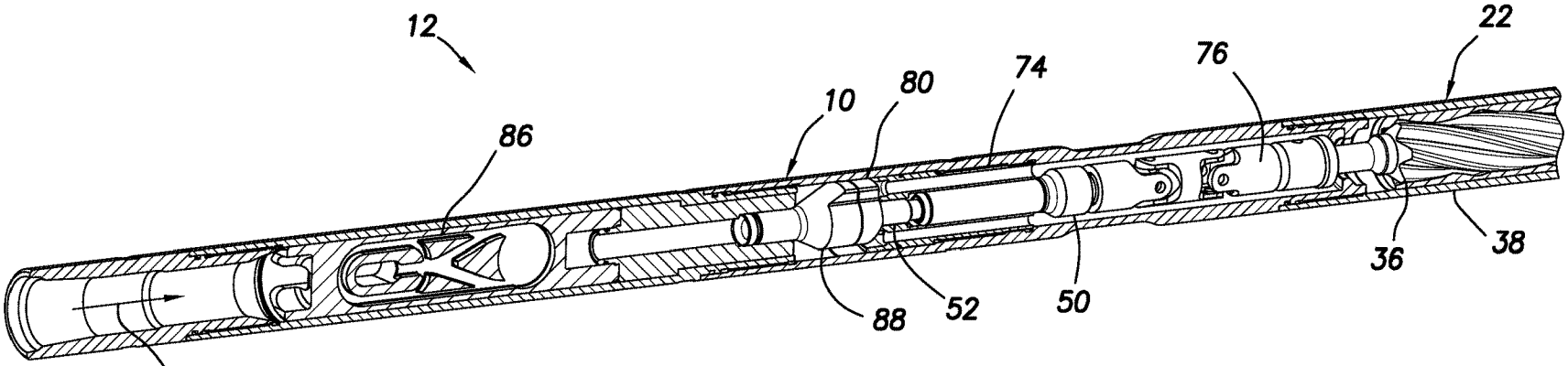
FIGS. 34 & 35 are representative perspective and partially cross-sectional views of another example of the fluid pulse generator and an upper portion of the fluid motor.
Figure 35:
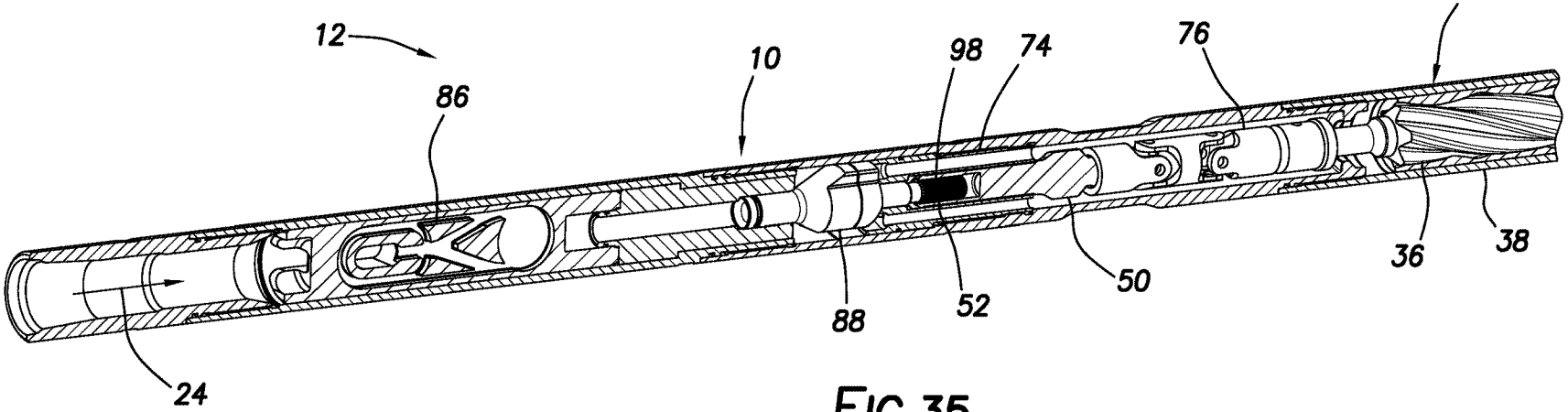

In FIGS. 34 & 35, it may be seen that the valve 80 is driven in a manner similar to the FIGS. 18 & 19 example, with the constant velocity joint assembly 76 being used to transmit rotation from the rotor 36 to an internally splined inner mandrel 50 rotationally supported in the bearing assembly 74. The flex joint 72 may be used in place of the constant velocity joint assembly 76 in other examples.

An externally splined shaft 52 is received in the inner mandrel 50 and is connected to a rotary valve element 88. The splined inner mandrel 50 and shaft 52 are the same as or similar to the variable length connection 98 described above.

Figure 36:
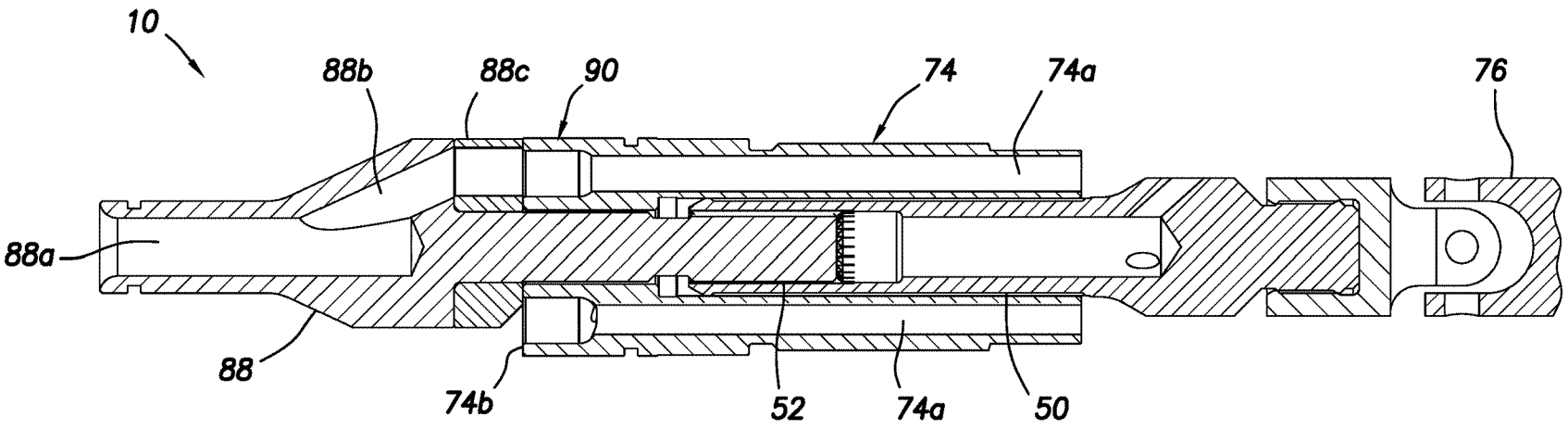
FIG. 36 is a representative cross-sectional view of a rotary valve assembly, inner mandrel and constant velocity joint used with the FIGS. 34 & 35 fluid pulse generator.
Figure 37:
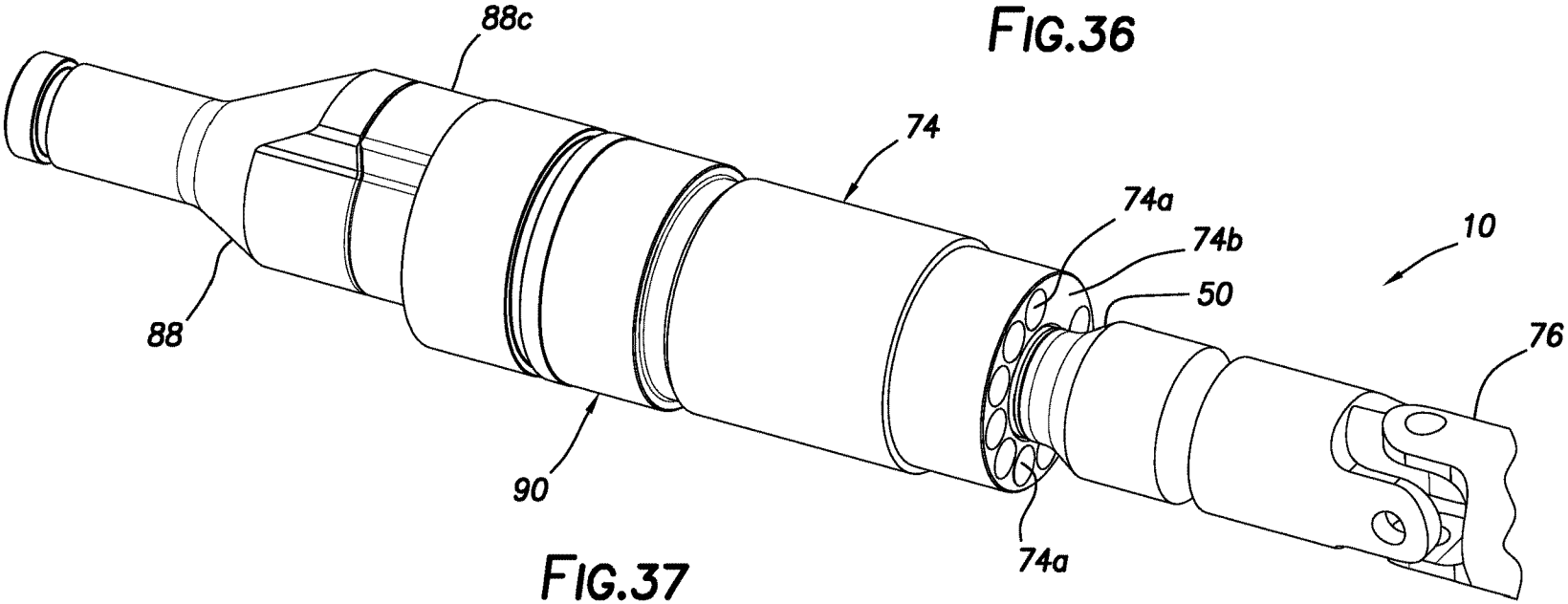
FIG. 37 is a representative perspective view of the rotary valve assembly, inner mandrel and constant velocity joint used with the FIGS. 34 & 35 fluid pulse generator.

In FIGS. 36 & 37, a rotary valve assembly 90 of the fluid pulse generator 10 is representatively illustrated. The rotary valve assembly 90 may be used for the valve 80 of FIGS. 33 & 62, although other types of valves may be used for the valve 80 in other examples.

The rotary valve assembly 90 may alternatively be used for the variable restrictor 56, for example, in the FIGS. 1-32 & 60-61B fluid pulse generator 10 embodiments. In that case, the rotary valve element 88 corresponds to the restrictor member 54 and the bearing assembly 74 corresponds to the ported member 58.

The rotary valve assembly 90 in the FIGS. 36 & 37 example includes the inner mandrel 50, the bearing assembly 74 and the rotary valve element 88. The rotary valve element 88 includes a central internal flow passage 88*a* and an intersecting radially offset flow passage 88*b*. The offset flow passage 88*b* also extends through a portion of a bearing wear element 88*c*.

In this example, the wear element 88*c* can comprise a relatively ductile bearing material selected for sliding engagement with an upper face 74*b* of the bearing assembly 74. Although the wear element 88*c* may sustain significant wear during operation of the fluid pulse generator 10, the wear element can be conveniently replaced during routine maintenance between jobs.

The bearing wear element 88*c* is in sliding contact with the upper face 74*b* of the bearing assembly 74. The ports 74*a* extend longitudinally through the bearing assembly 74, and at least one of the ports is open to flow at all times, so that fluid communication is continually permitted longitudinally through the bearing assembly 74.

Figure 38:
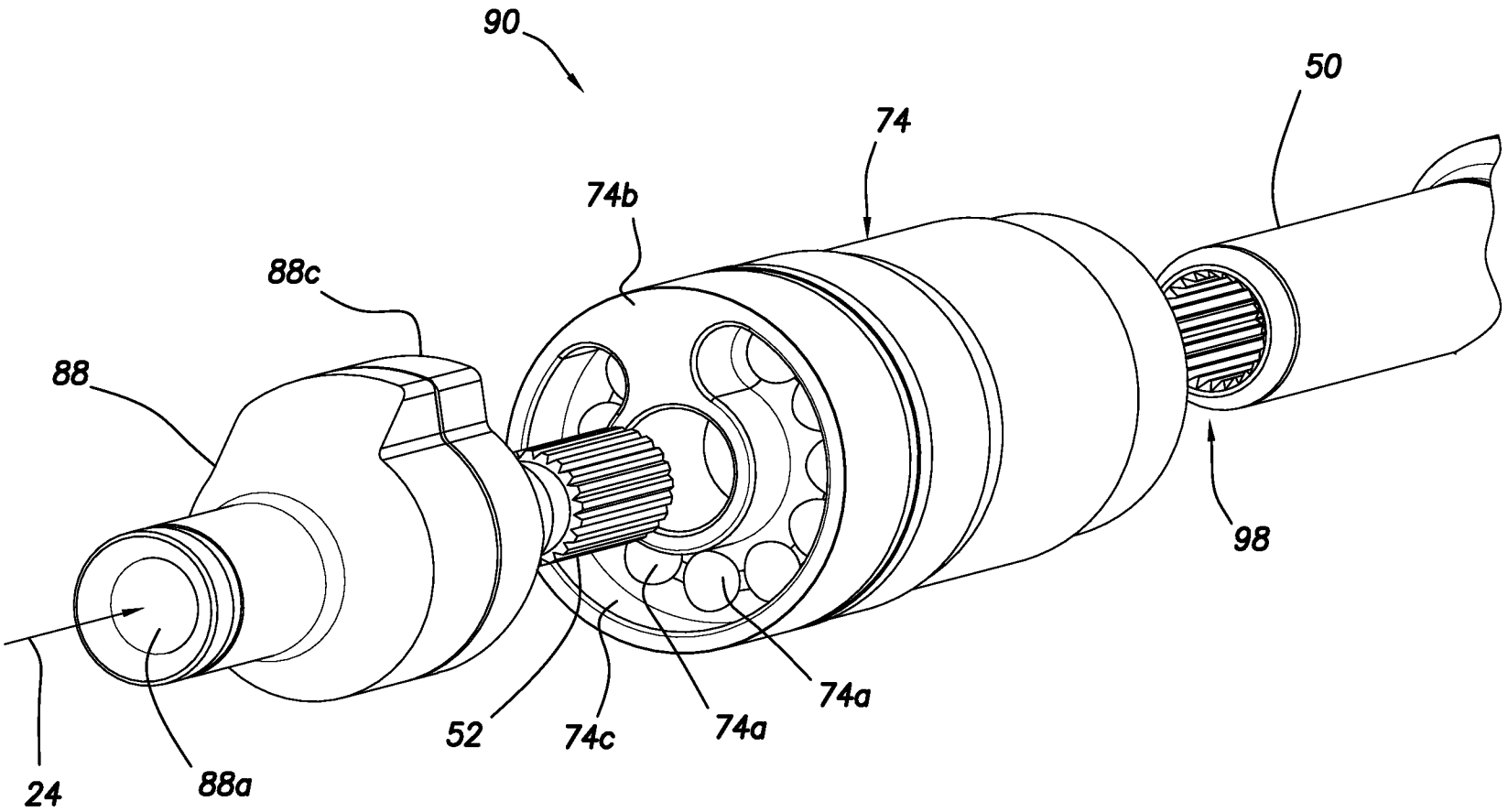
FIG. 38 is a representative exploded perspective view of the rotary valve assembly and inner mandrel used with the FIGS. 34 & 35 fluid pulse generator.

In FIG. 38 it may be seen that a circumferentially extending recess 74*c* is formed in the upper face 74*b* of the bearing assembly 74. The recess 74*c* does not extend a full 360 degrees in the upper face 74*b*. The recess 74*c* does permit fluid communication between all of the ports 74*a* in the bearing assembly 74, so that flow is always permitted through all of the ports.

A portion of the upper face 74*b* positioned between opposite ends of the recess 74*c* provides for blocking flow through the flow passage 88*b* in the rotary valve element 88, as described more fully below. Thus, a circumferential distance between the opposite ends of the recess 74*c* can be varied to correspondingly vary an extent of rotation of the rotary valve element 88 during which the flow passage 88*b* is blocked by the upper face 74*b* of the bearing assembly 74.

Note that the variable length connection 98 between the shaft 52 and the inner mandrel 50 permits the rotary valve element 88 to be biased into contact with the bearing assembly 74 by the flow of the fluid 24. Preferably, the rotary valve element 88 is configured so that bearing stress between the wear element 88*c* and the upper face 74*b* of the bearing assembly 74 is acceptably low to thereby reduce wear at this interface, while still permitting flow through the passages 88*a,b* to be blocked by the upper face 74*b* circumferentially between the ends of the recess 74*c*.

Figure 40:
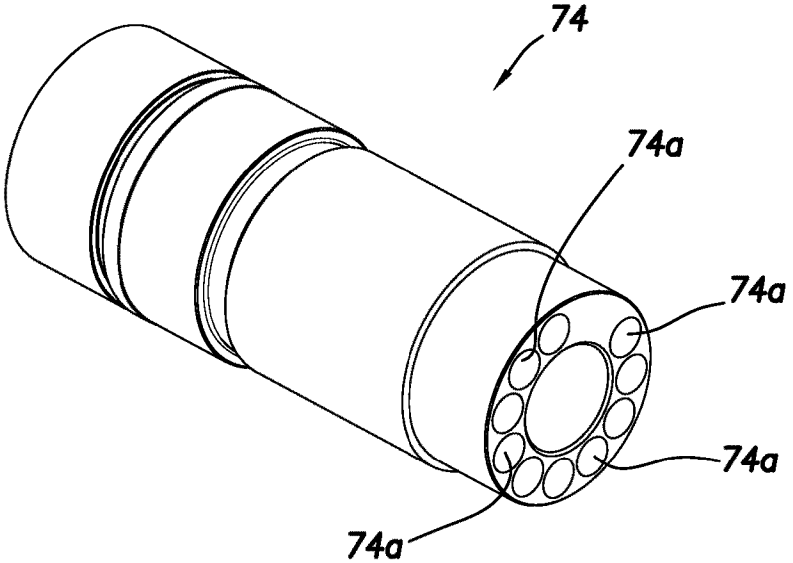
FIGS. 39, 40 & 41 are representative respective top, bottom perspective and top perspective views of a bearing assembly of the FIGS. 34 & 35 fluid pulse generator.
Figure 41:
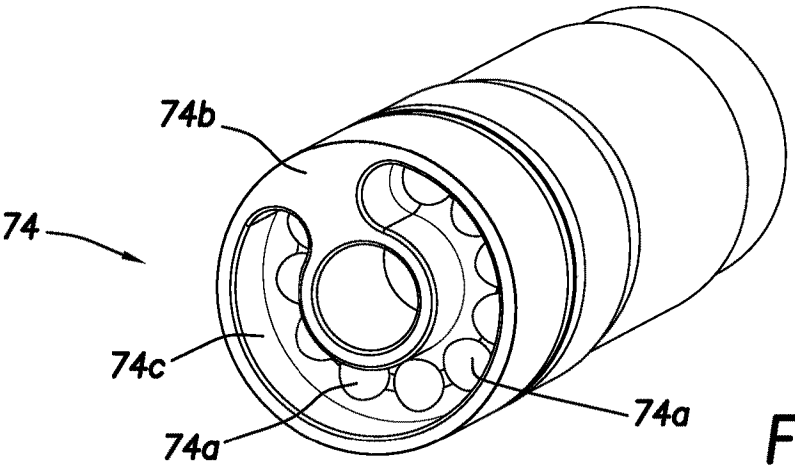
Figure 39:
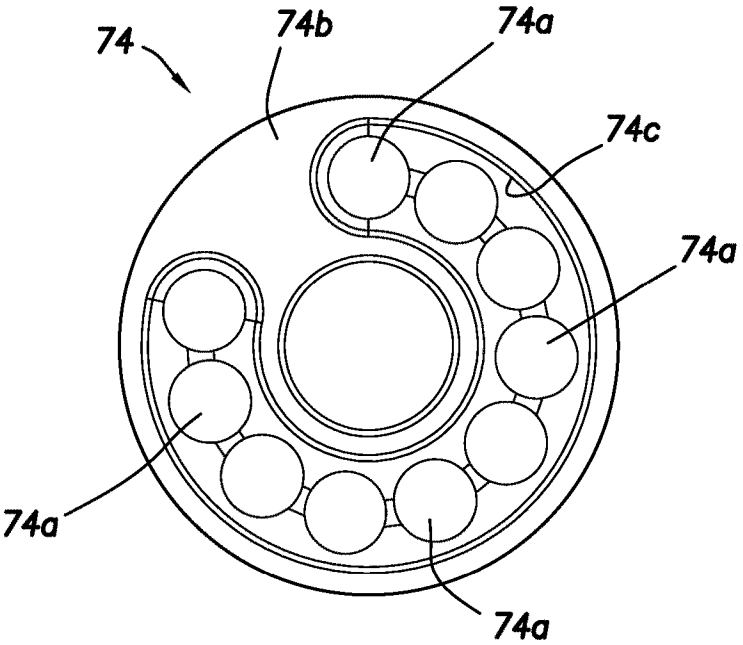

In FIGS. 39-41, various views of the bearing assembly 74 are representatively illustrated. In these views, the manner in which the circumferential recess 74*c* permits fluid communication between upper ends of the ports 74*a* can be clearly seen.

Figure 42:
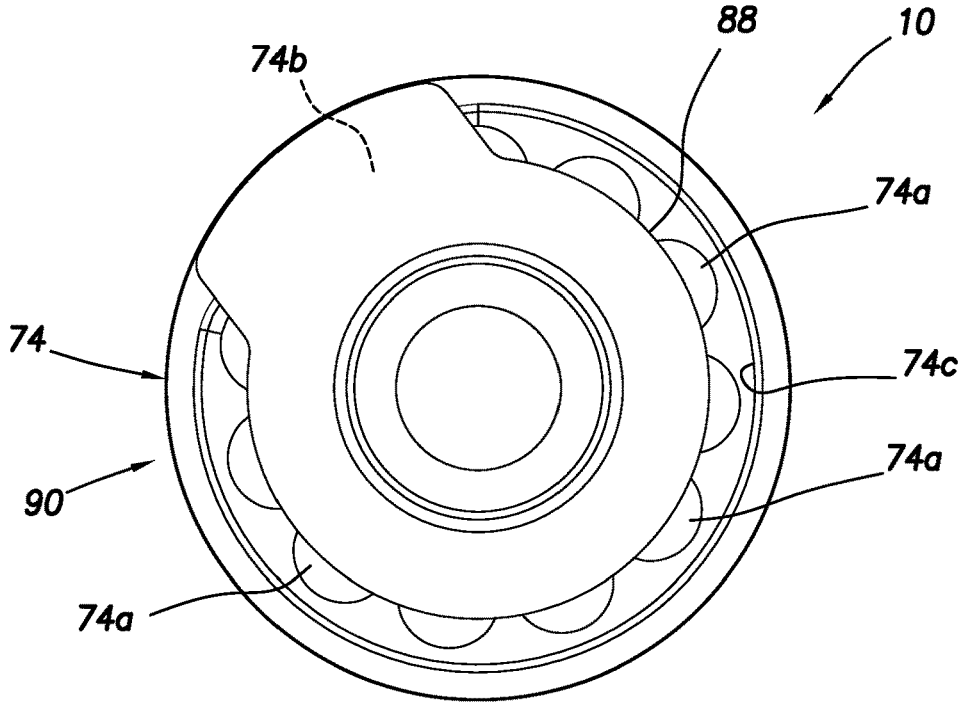
FIGS. 42 & 43 are representative top views of the rotary valve assembly FIGS. 34 & 35 fluid pulse generator in respective substantially restricted and substantially unrestricted configurations.
Figure 43:
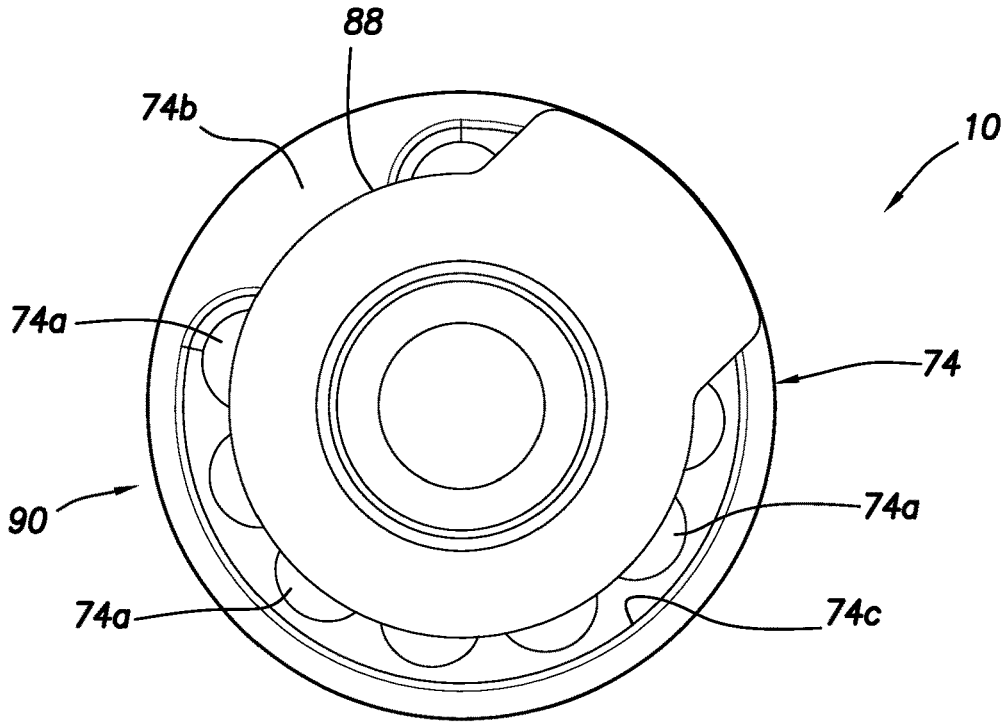
Figure 44:
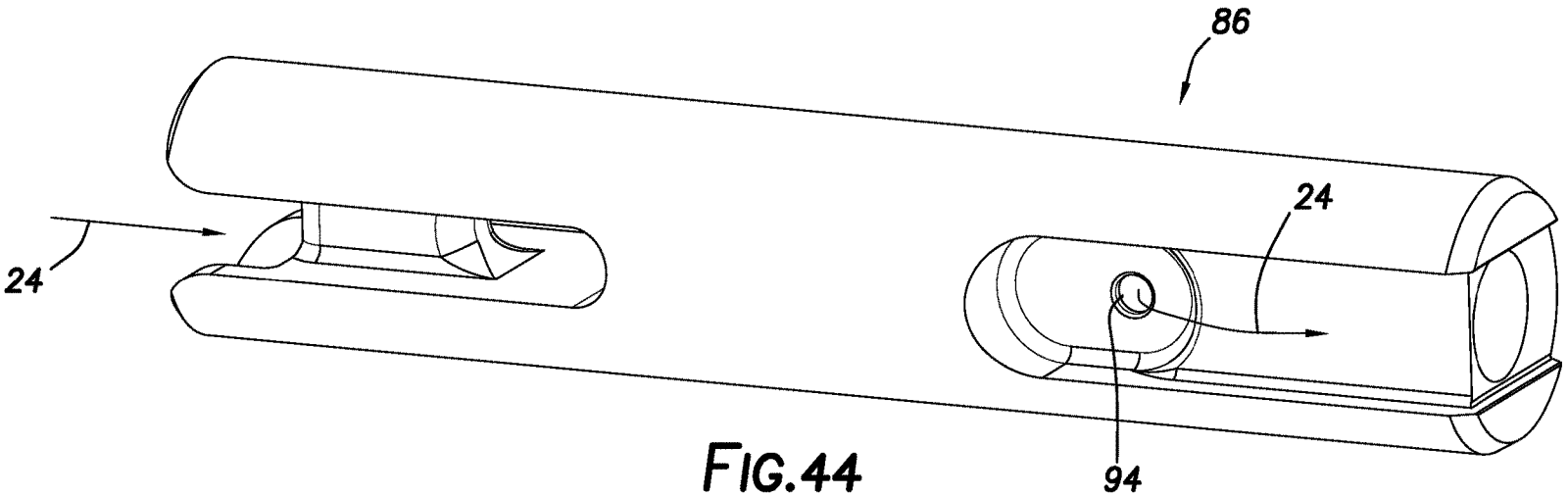
FIGS. 44 & 45 are representative perspective views of an example of a fluidic restrictor element that may be used with the FIGS. 34 & 35 fluid pulse generator.
Figure 45:
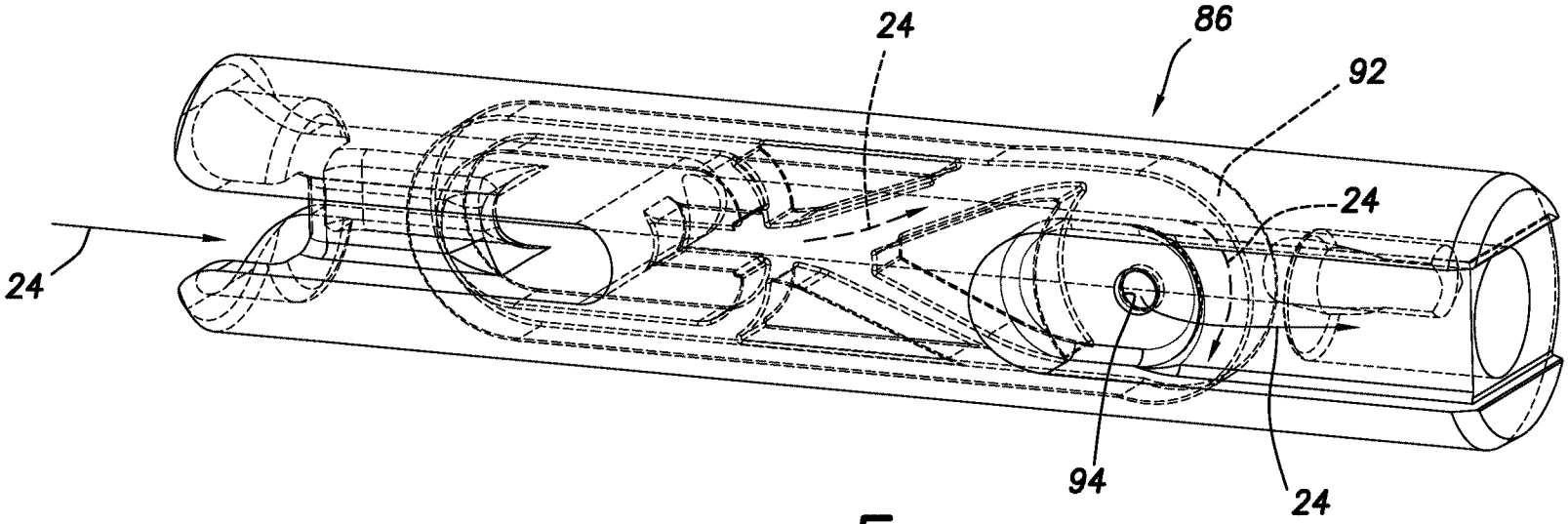
Figure 46:
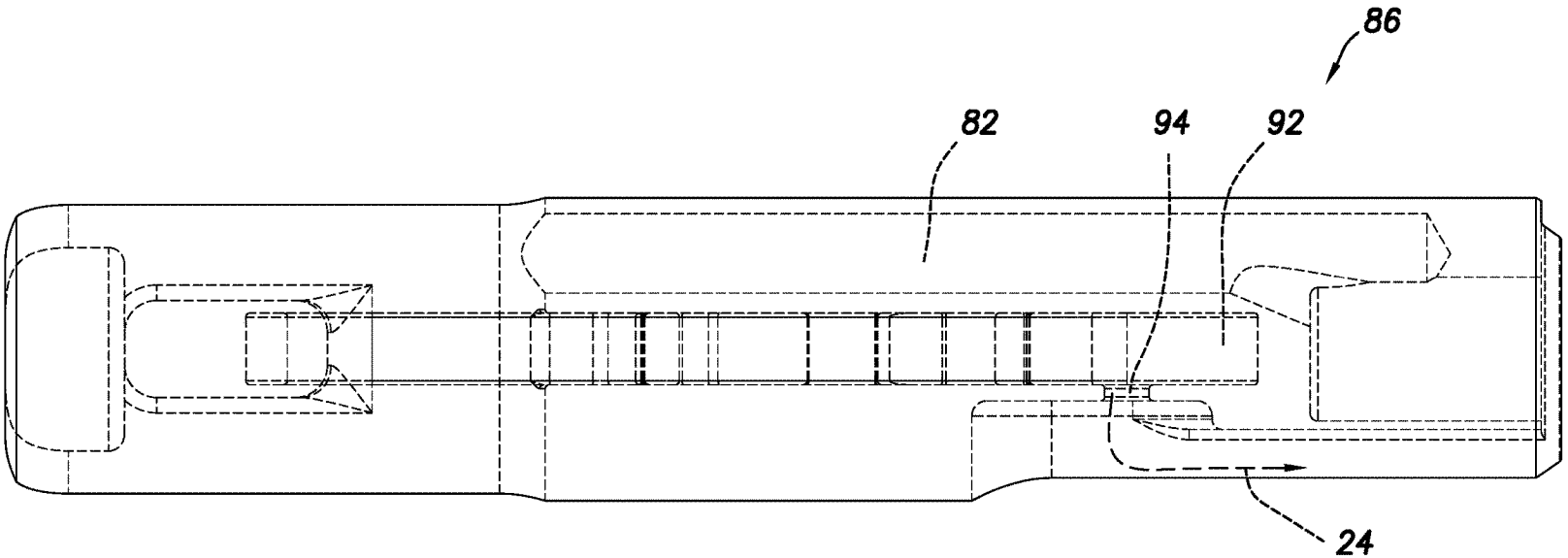
FIG. 46 is a representative side view of the fluidic restrictor element.
Figure 47:
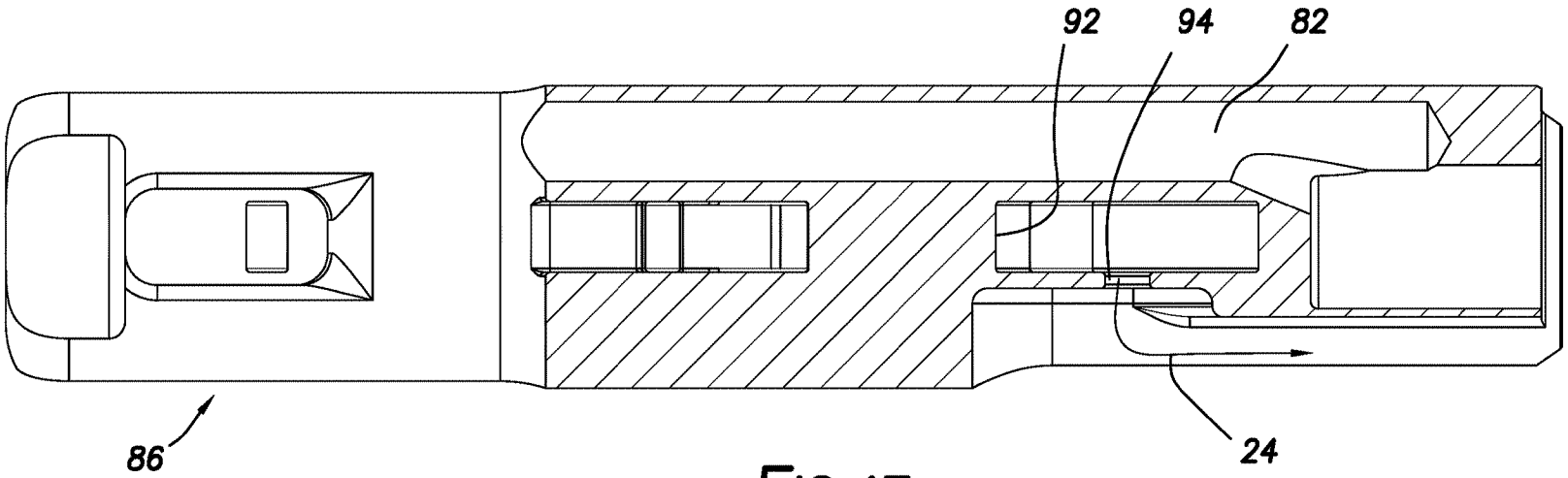
FIG. 47 is a representative cross-sectional view of the fluidic restrictor element.
Figure 48:
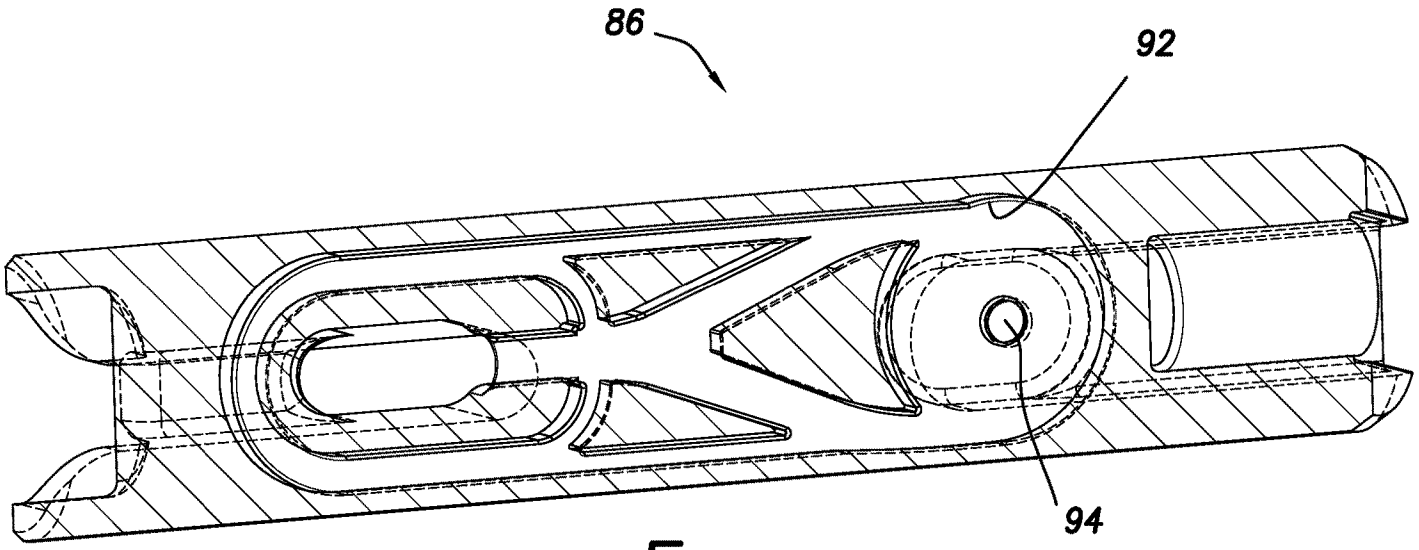
FIGS. 48 & 49 are representative perspective and cross-sectional views of the fluidic restrictor element.
Figure 49:
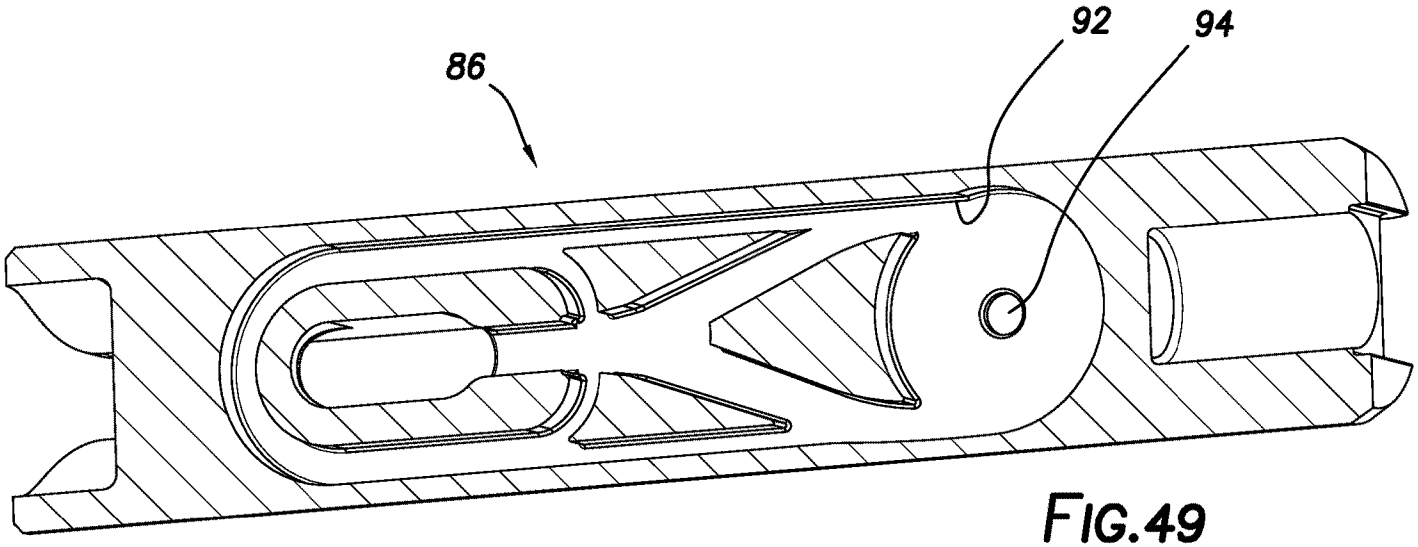

In FIGS. 42 & 43, top views of the rotary valve element 88 in different rotary positions relative to the bearing assembly 74 are depicted. In FIG. 42, the rotary valve element 88 is in a rotary position in which the flow passage 88*b* is blocked by the upper face 74*b* of the bearing assembly 74. In FIG. 43, the rotary valve element 88 is in a rotary position in which the flow passage 88*b* is not blocked by the upper face 74*b* of the bearing assembly 74. Note that, no matter the rotary position of the rotary valve element 88, flow is always permitted through the ports 74*a*.

Figure 59:
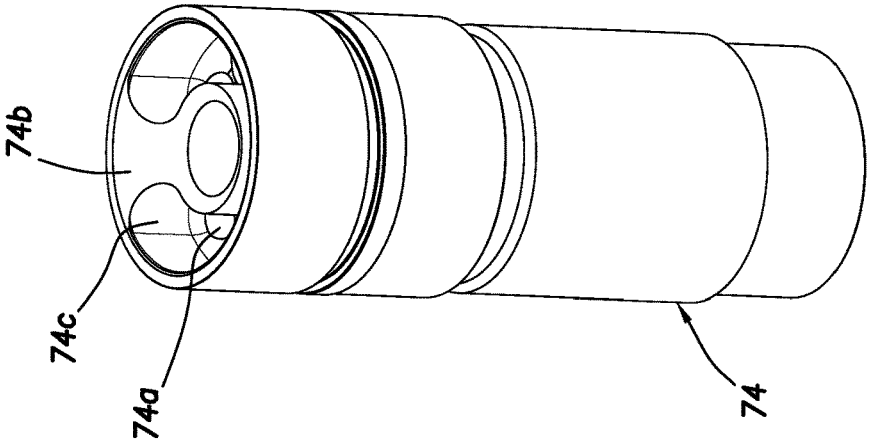
FIG. 59 is a representative side perspective view of an example of the bearing assembly of the FIG. 58 rotary valve assembly.
Figure 58:
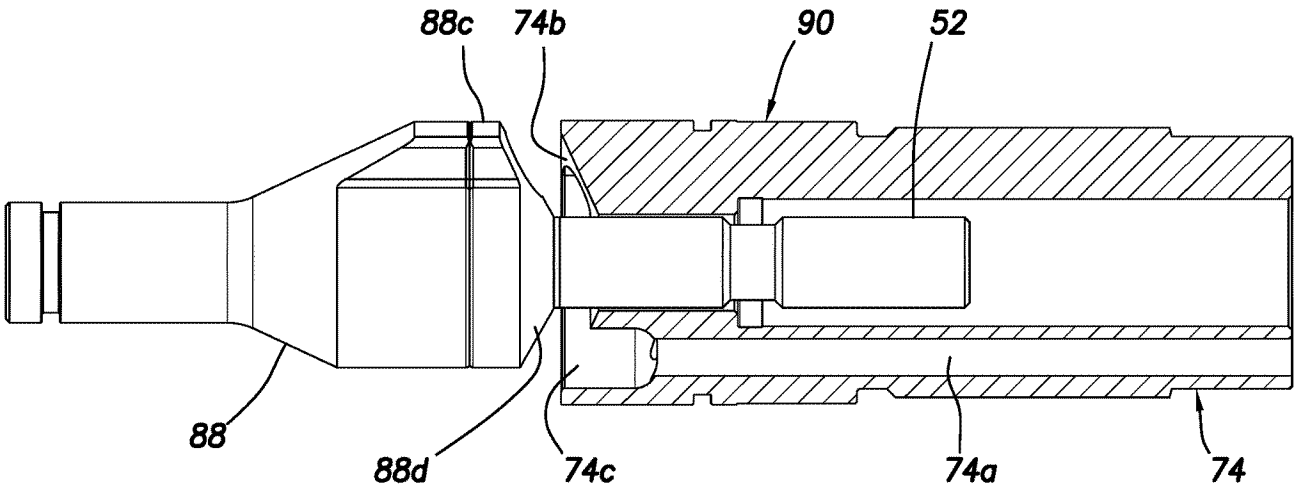
FIG. 58 is a representative cross-sectional view of another example of the rotary valve assembly.

Another example of the rotary valve assembly 90 is representatively illustrated in FIGS. 58 & 59. In this example, the upper face 74*b* of the bearing assembly 74 in concave frusta-conical shaped. A lower face 88*d* of the rotary valve element 88 is complementarily shaped (e.g., convex frusta-conical).

The FIGS. 58 & 59 rotary valve assembly 90 operates in a manner similar to that of the FIGS. 34-43 example. In addition, the frusta-conical shapes of the upper and lower faces 74*b*, 88*d* helps to align the rotary valve element 88 relative to the bearing assembly 74.

In FIGS. 44-49, different views of the fluidic restrictor element 86 are representatively illustrated. In this example, the fluidic restrictor element 86 comprises no separately moving parts, but the fluidic restrictor element is capable of producing variable resistance to flow in response to fluid flow through the fluidic restrictor element. The bypass flow path 82 also extends through the fluidic restrictor element 86 in this example.

The bypass flow path 82 is in fluid communication with the flow passages 88*a,b* in the rotary valve element 88 (see FIGS. 34 & 35). An upper end of the rotary valve element 88 may, for example, be received in a lower end of the fluidic restrictor element 86, so that the fluid 24 flowing from the bypass flow path flows into the flow passage 88*a* of the rotary valve element.

In this example, the fluidic restrictor element 86 includes a vortex chamber 92 having a central outlet 94. When flow through the bypass flow path 82 is blocked (such as, when the rotary valve element 88 is in the rotary position depicted in FIG. 42), the fluid 24 will flow through the vortex chamber 92 to the outlet 94, and then through the ports 74*a* in the bearing assembly 74, and then through the fluid motor 22. When the fluid 24 flows through the vortex chamber 92, the resistance to the flow of the fluid will alternately increase and decrease as rotational flow of the fluid in the vortex chamber alternately increases and decreases. The operation of the fluidic restrictor element 86 is more specifically described in the US patents referenced above.

When flow through the bypass flow path 82 is not blocked (such as, when the rotary valve element 88 is in the rotary position depicted in FIG. 43), the fluid 24 will flow through the bypass flow path, through the flow passages 88*a,b* in the rotary valve element 88, and then through the ports 74*a* in the bearing assembly 74, and then through the fluid motor 22. Note that flow through the vortex chamber 92 is continually permitted in this example, but the fluid 24 preferentially flows through the bypass flow path 82 when it is not blocked, since the bypass flow path has less resistance to the flow of the fluid.

Figures 50, 51, 52:
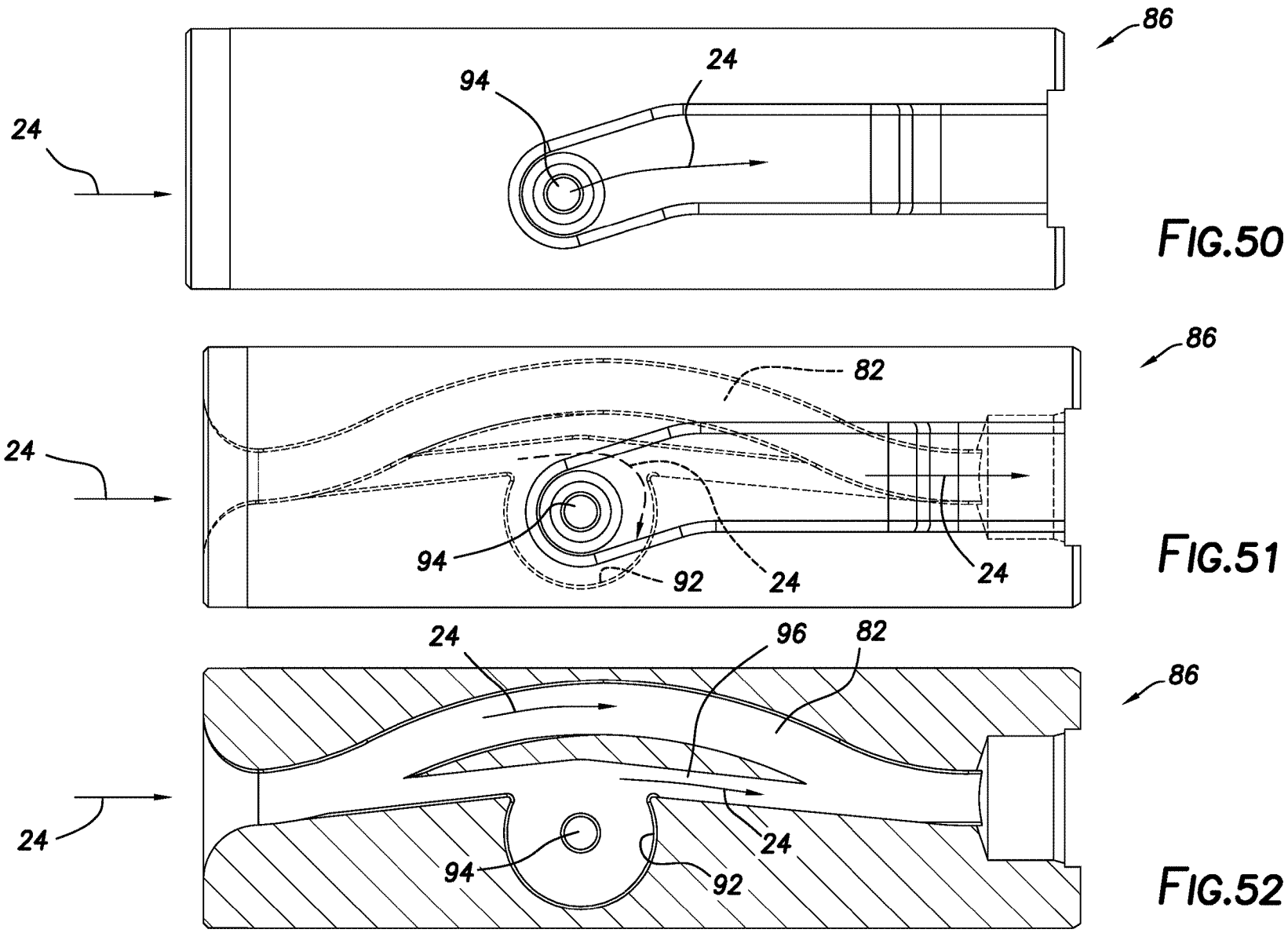
FIGS. 50, 51 & 52 are representative side and cross-sectional views of another example of the fluidic restrictor element.

In FIGS. 50-52, another example of the fluidic restrictor element 86 is representatively illustrated. In this example, the fluidic restrictor element 86 includes the bypass flow path 82, the vortex chamber 92 and the outlet 94, but the bypass flow path is in communication with the vortex chamber, so that when flow through the bypass flow path is unblocked, creation of a vortex in the vortex chamber is prevented.

In FIG. 51, flow of the fluid 24 through the bypass flow path 82 is blocked (such as, when the rotary valve element 88 is in the rotary position depicted in FIG. 42, downstream of the bypass flow path depicted in FIGS. 50-52). As a result, the fluid 24 flows into the vortex chamber 92, and then through the outlet 94. A vortex is created in the vortex chamber 92, thereby increasing the resistance to flow through the vortex chamber.

In FIG. 52, flow of the fluid 24 through the bypass flow path 82 is unblocked (such as, when the rotary valve element 88 is in the rotary position depicted in FIG. 43). As a result, the fluid 24 can flow unimpeded through the bypass flow path 82, and can also exit the vortex chamber 92 without creating a vortex therein (via a flow path 96 in communication with the bypass flow path 82, as well as via the outlet 94). Thus, the resistance to the flow of the fluid 24 through the fluidic restrictor element 86 is much less in FIG. 52 as compared to FIG. 51.

Figure 53:
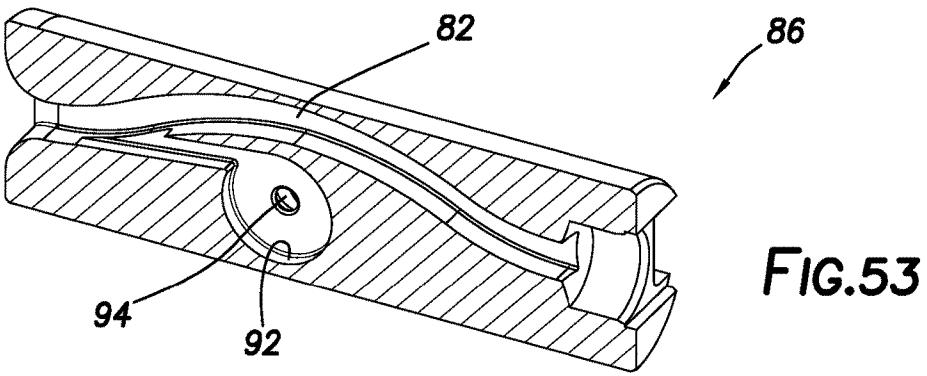
FIGS. 53, 54 & 55 are representative perspective and cross-sectional, side and cross-sectional views, respectively, of another example of the fluidic restrictor element.
Figure 54:
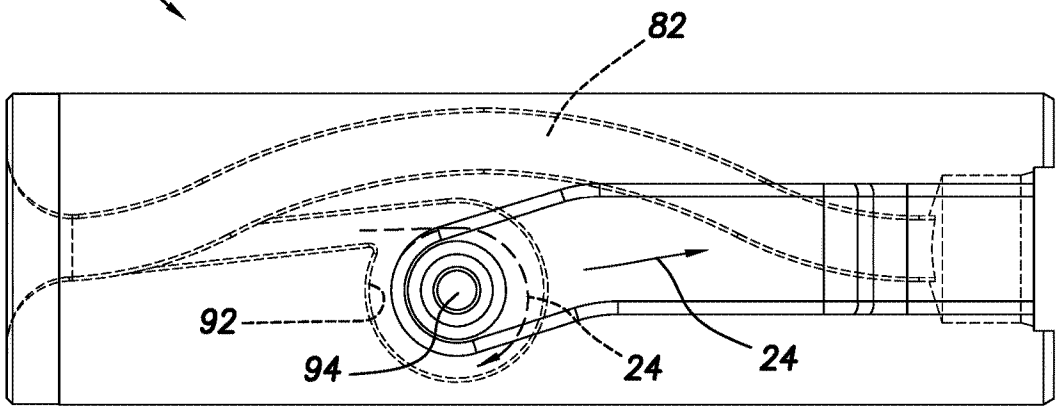
Figure 55:
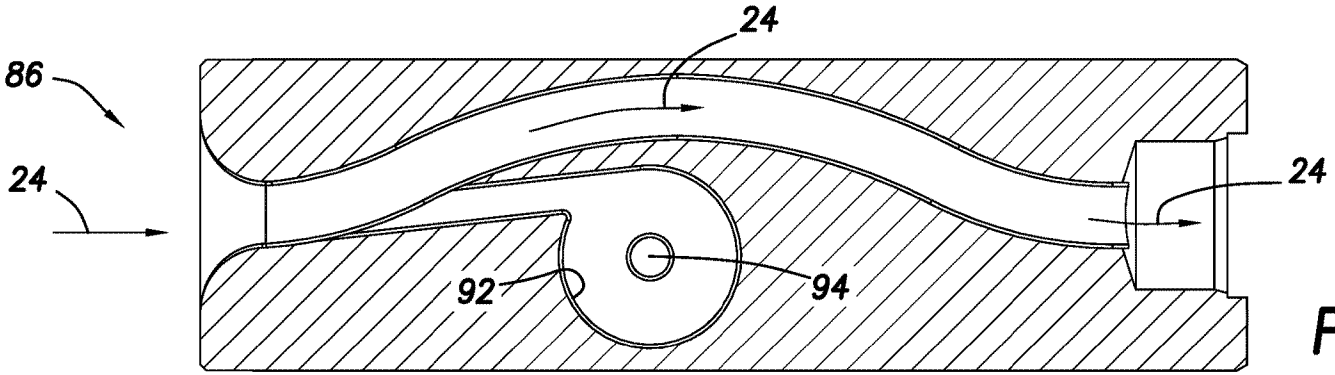

In FIGS. 53-55 another example of the fluidic restrictor element 86 is representatively illustrated. In this example, the fluid 24 preferentially flows through the bypass flow path 82 when it is unblocked, but the fluid is forced to flow through the vortex chamber 92 when the bypass flow path is blocked.

In FIG. 54, flow of the fluid 24 through the bypass flow path 82 is blocked (such as, when the rotary valve element 88 is in the rotary position depicted in FIG. 42). As a result, the fluid 24 flows into the vortex chamber 92, and then through the outlet 94. A vortex is created in the vortex chamber 92, thereby increasing the resistance to flow through the vortex chamber.

In FIG. 55, flow of the fluid 24 through the bypass flow path 82 is unblocked (such as, when the rotary valve element 88 is in the rotary position depicted in FIG. 43). As a result, the fluid 24 can flow unimpeded through the bypass flow path 82. Thus, the resistance to the flow of the fluid 24 through the fluidic restrictor element 86 is much less in FIG. 55 as compared to FIG. 54.

Figure 56:
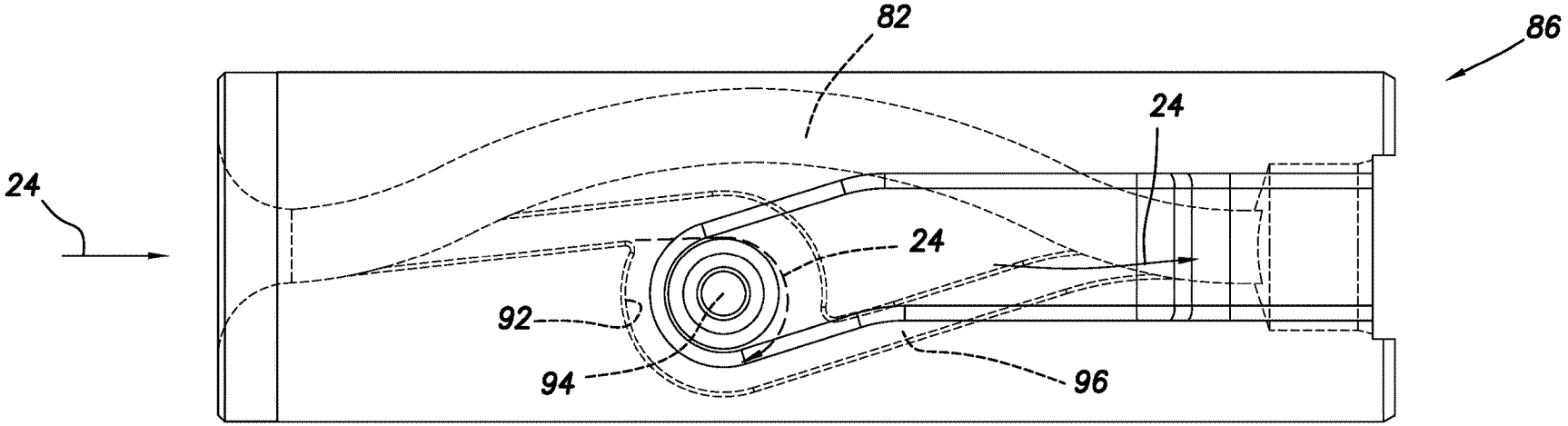
FIGS. 56 & 57 are representative respective side and cross-sectional views of another example of the fluidic restrictor element.
Figure 57:
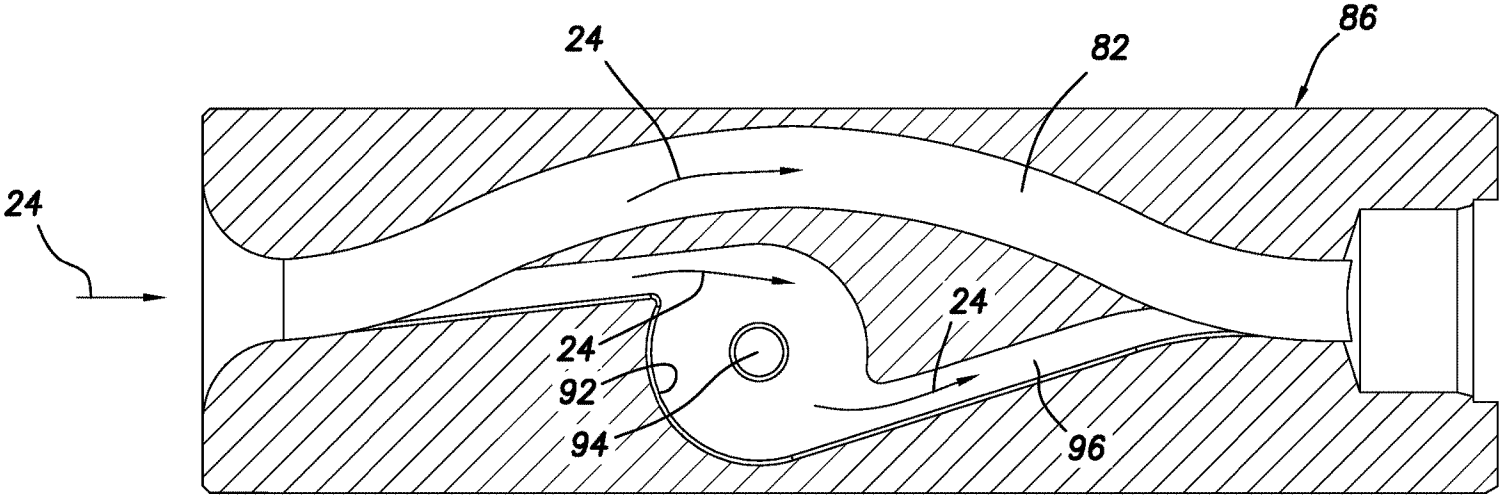

In FIGS. 56 & 57, another example of the fluidic restrictor element 86 is representatively illustrated. In this example, the fluidic restrictor element 86 includes the bypass flow path 82, the vortex chamber 92 and the outlet 94, but the bypass flow path is in communication with the vortex chamber, so that when flow through the bypass flow path is unblocked, creation of a vortex in the vortex chamber is prevented.

In FIG. 56, flow of the fluid 24 through the bypass flow path 82 is blocked (such as, when the rotary valve element 88 is in the rotary position depicted in FIG. 42). As a result, the fluid 24 flows into the vortex chamber 92, and then through the outlet 94. A vortex is created in the vortex chamber 92, thereby increasing the resistance to flow through the vortex chamber.

In FIG. 57, flow of the fluid 24 through the bypass flow path 82 is unblocked (such as, when the rotary valve element 88 is in the rotary position depicted in FIG. 43). As a result, the fluid 24 can flow unimpeded through the bypass flow path 82, and can also exit the vortex chamber 92 without creating a vortex therein (via the outlet 94 and the flow path 96 in communication with the bypass flow path 82). Thus, the resistance to the flow of the fluid 24 through the fluidic restrictor element 86 is much less in FIG. 57 as compared to FIG. 56.

In the examples of FIGS. 33-57, the fluid motor 22 rotates the rotary valve element 88 via the constant velocity joint assembly 76, the inner mandrel 50 and the shaft 52. The flex joint 72 may be used in place of the constant velocity joint assembly 76 in other examples.

As the rotary valve element 88 rotates, flow through the bypass flow path 82 is unblocked during a majority of each rotation. However, when the flow passage 88*b* is positioned between the circumferential ends of the recess 77*c*, flow through the passages 88*a,b* and the bypass flow path 82 is blocked by the upper face 77*b* of the bearing assembly 77, so that all of the fluid 24 is forced to flow through the vortex chamber 92 of the fluidic restrictor element 86.

In the example of FIGS. 44-49, a vortex is alternately created and collapsed in the vortex chamber 92, so that the resistance to flow of the fluid 24 through the vortex chamber alternately increases and decreases. A frequency and an amplitude of this alternating flow resistance can be selected by appropriate configuration of the vortex chamber 92 and associated flow paths in communication with the vortex chamber.

In the examples of FIGS. 50-57, a vortex is created in the vortex chamber 92 when flow through the bypass flow path 82 is blocked. This increases the resistance to flow of the fluid 24 through the vortex chamber 92. An amplitude of this increased flow resistance can be selected by appropriate configuration of the vortex chamber 92 and associated flow paths in communication with the vortex chamber.

When flow through the bypass flow path 82 is unblocked, the resistance to the flow of the fluid 24 is substantially decreased. In the examples of FIGS. 44-49 & 53-55, the flow is preferentially through the bypass flow path 82, so that only a minimal amount of the fluid 24 flows through the vortex chamber 92, although a vortex can still be created in the vortex chamber.

In the examples of FIGS. 50-52, 56 & 57, creation of a vortex in the vortex chamber 92 is prevented when the bypass flow path 82 is unblocked. This is due to the flow path 96 which connects the vortex chamber 92 to the bypass flow path 82.

Thus, as the rotary valve element 88 is rotated by the fluid motor 22, the resistance to flow of the fluid 24 is increased (alternating as in the FIGS. 44-49 example, or steady state as in the FIGS. 50-57 examples) when the bypass flow path 82 is blocked, and the resistance to flow of the fluid is decreased when the bypass flow path is unblocked.

Figure 62:
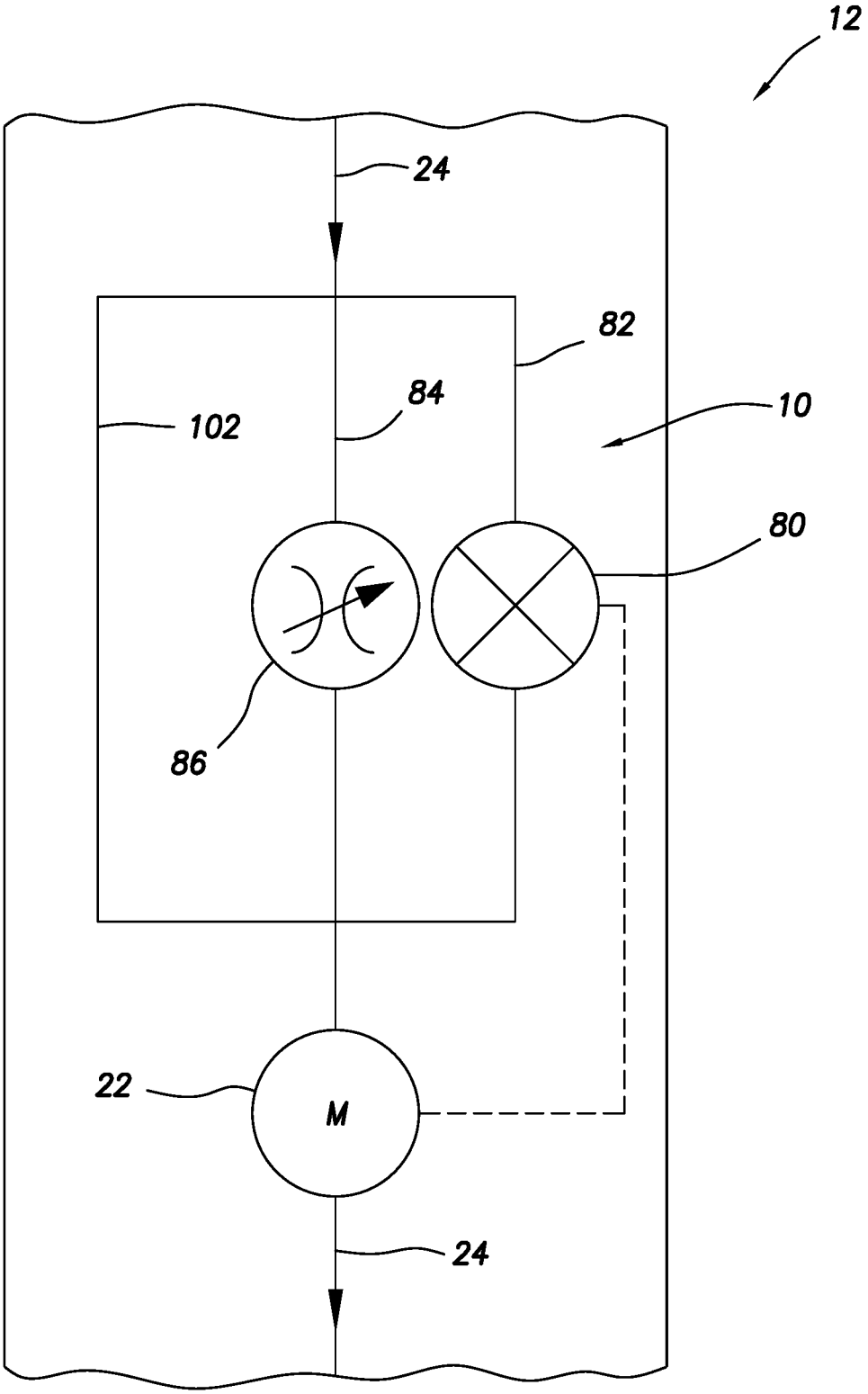
FIG. 62 is a representative schematic view of another example of the fluid pulse generator.

Referring additionally now to FIG. 62, another example of the fluid pulse generator 10 is representatively illustrated. The FIG. 62 example is similar in many respects to the FIG. 33 example. However, the FIG. 62 fluid pulse generator 10 includes an additional bypass flow path 102 connected in parallel with the bypass flow path 82 and the flow path 84.

The bypass flow path 102 allows the fluid 24 to flow past both of the valve 80 and the fluidic restrictor element 86. This can be useful when it is not desired for the fluid pulse generator 10 to generate fluid pulses, for example, when conveying the drill string 14 into or out of a vertical section of the wellbore 16 (see FIG. 1).

When it is desired to generate fluid pulses, the bypass flow path 102 can be blocked to thereby force the fluid 24 to flow through the bypass flow path 82 and the flow path 84 as described above for the FIG. 33 example. In order to block the bypass flow path 102, a plug 104 (such as, a ball, a dart, etc.) can be deployed into the bypass flow path 102, so that the plug engages a seat 106 therein, as depicted in FIG. 63.

In the FIG. 63 example, the fluid pulse generator 10 includes an excluder 108 that prevents the plug 104 from entering the bypass flow path 82 or the flow path 84, but allows the plug to enter the bypass flow path 102. A filter or slot 110 in the excluder 108 permits the fluid 24 to flow into the bypass flow path 82 and the flow path 84 at all times, but the slot is narrower than a width of the plug 104, so that the plug is excluded from passing through the slot.

It may now be fully appreciated that the above disclosure provides significant advancements to the art of generating fluid pulses in subterranean wells. In various examples described above, a fluid pulse generator 10 generates fluid pulses in response to fluid flow 24 through the fluid pulse generator and a fluid motor 22 connected downstream of the fluid pulse generator.

The above disclosure provides to the art a fluid pulse generator 10 for use with a subterranean well. In one example, the fluid pulse generator 10 can include a fluid motor 22 including a rotor 36 configured to rotate in response to fluid flow 24 through the fluid motor 22, a variable flow restrictor 56 positioned upstream of the fluid motor 22, the variable flow restrictor 56 including a restrictor member 54 rotatable by the rotor 36 relative to a ported member 58 to thereby variably restrict the fluid flow 24. The restrictor member 54 is longitudinally displaceable relative to the rotor 36.

A variable length connection 98 may transmit rotation and torque from the rotor 36 to the restrictor member 54. The variable length connection 98 may comprise a splined connection.

The fluid flow 24 may bias the restrictor member 54 against the ported member 58. A bearing stress between surfaces 54*a*, 58*a* of the restrictor member 54 and the ported member 58 may increase in response to the fluid flow 24. The surfaces 88*d*, 74*b* of the restrictor member (e.g., the rotary valve element 88) and the ported member (e.g., the bearing assembly 74) may be frusta-conical shaped, for example, as depicted in FIG. 58.

A flow area for the fluid flow 24 through the variable flow restrictor 56 may be more than fifty percent open in a majority of each cycle of rotation of the restrictor member 54. A flow area for the fluid flow 24 through the variable flow restrictor 56 may be less than fifty percent open in a minority of each cycle of rotation of the restrictor member 54.

At least one of a flex joint 72 and a constant velocity joint 76 may be connected between the restrictor member 54 and the rotor 36.

The restrictor member 54 may rotate and revolve about a central longitudinal axis 66 of the fluid motor 22.

A bearing section 30 may be connected to the rotor 36 on a side of the rotor 36 opposite the variable flow restrictor 56.

Another example of the fluid pulse generator 10 can comprise a fluid motor 22 including a rotor 36 configured to rotate in response to fluid flow 24 through the fluid motor 22, a variable flow restrictor 56 positioned upstream of the fluid motor 22, the variable flow restrictor 56 including a restrictor member 54 rotatable by the rotor 36 relative to a ported member 58 to thereby variably restrict the fluid flow 24, and at least one of a flex joint 72 and a constant velocity joint 76 connected between the restrictor member 54 and the rotor 36.

A splined connection 98 may be connected between the restrictor member 54 and the flex joint 72 or the constant velocity joint 76. A variable length connection 98 may transmit rotation and torque from the rotor 36 to the restrictor member 54.

The fluid flow 24 may bias the restrictor member 54 against the ported member 58. A bearing stress between surfaces 54*a*, 58*a* of the restrictor member 54 and the ported member 58 may increase in response to the fluid flow 24.

The ported member 58 may outwardly surround the restrictor member 54, for example, as depicted in FIGS. 20-32. The restrictor member 54 may be circumferentially rotatable about the ported member 58, for example, as depicted in FIGS. 60-61B.

The restrictor member 54 may periodically block the fluid flow 24 radially through the ported member 58. The restrictor member 54 may be longitudinally displaceable within the ported member 58.

The restrictor member 54 may block a port 58*d* formed through the ported member 58 less than fifty percent of a cycle of rotation of the restrictor member 54. The fluid flow 24 may be continually permitted through the variable flow restrictor 56.

Another fluid pulse generator 10 can comprise a fluid motor 22 including a rotor 36 configured to rotate in response to fluid flow 24 through the fluid motor 22, and a variable flow restrictor 56 positioned upstream of the fluid motor 22, the variable flow restrictor 56 including a valve 80, 90 and a fluidic restrictor element 86, and the valve 80, 90 being operable in response to rotation of the rotor 36. The fluidic restrictor element 86 is configured to generate fluid pulses in response to the fluid flow 24 through a first flow path 84, and the valve 80, 90 is configured to control the fluid flow 24 through a second flow path 82 connected in parallel with the first flow path 84.

The first and second fluid paths 84, 82 may be connected upstream of the fluid motor 22.

The rotor 36 may be connected to a rotary valve element 88 of the valve 80, 90. The rotor 36 may rotate the rotary valve element 88 relative to a ported bearing assembly 74 in response to the fluid flow 24.

At least one of a flex joint 72 and a constant velocity joint 76 may be connected between the rotor 36 and the rotary valve element 88. A splined connection 98 may be connected between the rotary valve element 88 and the flex joint 72 or the constant velocity joint 76. A variable length connection 98 may transmit rotation and torque from the rotor 36 to the rotary valve element 88.

The second flow path 82 may extend through the fluidic restrictor element 86. The fluid flow 24 may enter the second flow path 82 upstream of a vortex chamber 92 of the fluidic restrictor element 86, and the fluid flow 24 may exit the second flow path 82 downstream of the vortex chamber 92. The fluid flow 24 through the second flow path 82 may prevent generation of the fluid pulses by the fluidic restrictor element 86.

A third flow path 102 may be connected in parallel with the first and second flow paths 84, 82. The fluid flow 24 through the third flow path 102 may prevent generation of the fluid pulses by the fluidic restrictor element 86.

A seat 106 may be formed in the third flow path 102. The seat 106 may be blocked by a plug 104 to prevent the fluid flow 24 through the third flow path 102.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A fluid pulse generator for use with a subterranean well, the fluid pulse generator comprising:

a fluid motor including a rotor configured to rotate in response to fluid flow through the fluid motor;

a variable flow restrictor positioned upstream of the fluid motor, the variable flow restrictor including a restrictor member rotatable by the rotor relative to a ported member to thereby variably restrict the fluid flow; and the restrictor member being longitudinally displaceable relative to the rotor during operation of the fluid pulse generator, in which a variable length connection transmits rotation and torque from the rotor to the restrictor member, and in which the variable length connection comprises a splined connection.

2. The fluid pulse generator of claim 1, in which the fluid flow biases the restrictor member against the ported member.

3. The fluid pulse generator of claim 1, in which a bearing stress between surfaces of the restrictor member and the ported member increases in response to the fluid flow.

4. The fluid pulse generator of claim 3, in which the surfaces of the restrictor member and the ported member are frusta-conical shaped.

5. The fluid pulse generator of claim 1, in which a flow area for the fluid flow through the variable flow restrictor is more than fifty percent open in a majority of each cycle of rotation of the restrictor member.

6. The fluid pulse generator of claim 1, in which a flow area for the fluid flow through the variable flow restrictor is less than fifty percent open in a minority of each cycle of rotation of the restrictor member.

7. The fluid pulse generator of claim 1, in which at least one of the group consisting of a flex joint and a constant velocity joint is connected between the restrictor member and the rotor.

8. The fluid pulse generator of claim 1, in which the restrictor member rotates and revolves about a central longitudinal axis of the fluid motor.

9. The fluid pulse generator of claim 1, in which a bearing section is connected to the rotor on a side of the rotor opposite the variable flow restrictor.

10. A fluid pulse generator for use with a subterranean well, the fluid pulse generator comprising:

a fluid motor including a rotor configured to rotate in response to fluid flow through the fluid motor;

a variable flow restrictor positioned upstream of the fluid motor, the variable flow restrictor including a restrictor member rotatable by the rotor relative to a ported member to thereby variably restrict the fluid flow, in which the restrictor member is longitudinally displaceable relative to the rotor during operation of the fluid pulse generator, and in which the restrictor member is longitudinally displaceable within the ported member; and at least one of the group consisting of a flex joint and a constant velocity joint connected between the restrictor member and the rotor.

11. The fluid pulse generator of claim 10, in which a splined connection is connected between the restrictor member and the at least one of the group consisting of the flex joint and the constant velocity joint.

12. The fluid pulse generator of claim 10, in which a variable length connection transmits rotation and torque from the rotor to the restrictor member.

13. The fluid pulse generator of claim 10, in which the fluid flow biases the restrictor member against the ported member.

14. The fluid pulse generator of claim 10, in which a bearing stress between surfaces of the restrictor member and the ported member increases in response to the fluid flow.

15. The fluid pulse generator of claim 14, in which the surfaces of the restrictor member and the ported member are frusta-conical shaped.

16. The fluid pulse generator of claim 10, in which the ported member outwardly surrounds the restrictor member.

17. The fluid pulse generator of claim 10, in which the restrictor member is circumferentially rotatable about the ported member.

18. The fluid pulse generator of claim 10, in which the restrictor member periodically blocks the fluid flow radially through the ported member.

19. The fluid pulse generator of claim 10, in which the restrictor member blocks a port formed through the ported member less than fifty percent of a cycle of rotation of the restrictor member.

20. The fluid pulse generator of claim 10, in which the fluid flow is continually permitted through the variable flow restrictor.

21. A fluid pulse generator for use with a subterranean well, the fluid pulse generator comprising:

a fluid motor including a rotor configured to rotate in response to fluid flow through the fluid motor; and a variable flow restrictor positioned upstream of the fluid motor, the variable flow restrictor including a valve and a fluidic restrictor element, and the valve being operable in response to rotation of the rotor, in which the fluidic restrictor element is configured to generate fluid pulses in response to the fluid flow through a first flow path, and the valve is configured to control the fluid flow through a second flow path connected in parallel with the first flow path, and in which the fluid flow enters the second flow path upstream of a vortex chamber of the fluidic restrictor element, and the fluid flow exits the second flow path downstream of the vortex chamber.

22. The fluid pulse generator of claim 21, in which the first and second fluid paths are connected upstream of the fluid motor.

23. The fluid pulse generator of claim 21, in which the rotor is connected to a rotary valve element of the valve.

24. The fluid pulse generator of claim 23, in which the rotor rotates the rotary valve element relative to a ported bearing assembly in response to the fluid flow.

25. The fluid pulse generator of claim 23, in which at least one of the group consisting of a flex joint and a constant velocity joint is connected between the rotor and the rotary valve element.

26. The fluid pulse generator of claim 25, in which a splined connection is connected between the rotary valve element and the at least one of the group consisting of the flex joint and the constant velocity joint.

27. The fluid pulse generator of claim 23, in which a variable length connection transmits rotation and torque from the rotor to the rotary valve element.

28. The fluid pulse generator of claim 21, in which the second flow path extends through the fluidic restrictor element.

29. The fluid pulse generator of claim 21, in which the fluid flow through the second flow path prevents generation of the fluid pulses by the fluidic restrictor element.

30. The fluid pulse generator of claim 21, in which a third flow path is connected in parallel with the first and second flow paths, and the fluid flow through the third flow path prevents generation of the fluid pulses by the fluidic restrictor element.

31. The fluid pulse generator of claim 30, in which a seat is formed in the third flow path, and the seat is blockable by a plug to prevent the fluid flow through the third flow path.

* * * * *